US012297593B2

(12) United States Patent
Granberry et al.

(10) Patent No.: US 12,297,593 B2
(45) Date of Patent: May 13, 2025

(54) MULTIFUNCTIONAL ACTIVE YARNS AND TEXTILES

(71) Applicants: REGENTS OF THE UNIVERSITY OF MINNESOTA, Minneapolis, MN (US); UNITED STATES GOVERNMENT ADMINISTRATOR OF NASA, Washington, DC (US)

(72) Inventors: Rachael Granberry, Saint Paul, MN (US); Santo Padula, II, Minneapolis, MN (US); Bradley Holschuh, North Oaks, MN (US); Julianna Abel, Minneapolis, MN (US); Charles Weinberg, Minneapolis, MN (US); Justin Barry, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 210 days.

(21) Appl. No.: 17/756,605

(22) PCT Filed: Dec. 2, 2020

(86) PCT No.: PCT/US2020/070841

§ 371 (c)(1),
(2) Date: May 27, 2022

(87) PCT Pub. No.: WO2021/133864

PCT Pub. Date: Jun. 10, 2021

(65) Prior Publication Data

US 2023/0002937 A1 Jan. 5, 2023

Related U.S. Application Data

(60) Provisional application No. 62/942,582, filed on Dec. 2, 2019.

(51) Int. Cl.
*D07B 1/00* (2006.01)

(52) U.S. Cl.
CPC ..... *D07B 1/005* (2013.01)

(58) Field of Classification Search
CPC ..... D02G 3/441; D07B 1/005; D04B 1/12; D04B 1/22; D10B 2101/122; D10B 2501/043; D10B 2509/028; D10B 2401/00; D10B 2401/046
See application file for complete search history.

(56) References Cited

U.S. PATENT DOCUMENTS 4,087,295 A * 5/1978 Sargent ..... B60C 9/0007 148/333
2008/0170982 A1* 7/2008 Zhang ..... D02G 3/44 423/447.3
2010/0065981 A1* 3/2010 Liao ..... D06M 13/127 264/165

(Continued)

*Primary Examiner* — Bao-Thieu L Nguyen
(74) *Attorney, Agent, or Firm* — Merchant & Gould P.C.

(57) ABSTRACT

Yarns incorporating filaments of shape memory materials are described herein that enable the creation of fabrics, garments, and other materials with tunable force absorption or exertion capabilities, as well as creating complex shapes and structures upon actuation. Systems and methods described herein enable selective buckling, recruitment, compression, and other desirable phenomena by actuating fibers in knitted patterns, whether used as isolated filaments or in twisted yarns.

4 Claims, 36 Drawing Sheets

(56) References Cited

U.S. PATENT DOCUMENTS

| | | | | |
|---|---|---|---|---|
| 2011/0092121 | A1* | 4/2011 | Kapsali | D03D 15/567 156/60 |
| 2015/0073318 | A1* | 3/2015 | Holschuh | A61F 13/08 601/84 |
| 2015/0073319 | A1* | 3/2015 | Holschuh | B64G 6/00 601/84 |
| 2017/0304136 | A1* | 10/2017 | Holschuh | A61H 1/008 |
| 2018/0179779 | A1* | 6/2018 | Lacarbonara | D07B 5/00 |
| 2020/0022803 | A1* | 1/2020 | Mirvakili | F03G 7/06 |
| 2020/0240051 | A1* | 7/2020 | Carls | D03D 15/41 |
| 2022/0338577 | A1* | 10/2022 | Eschen | A61F 13/08 |

* cited by examiner

100G

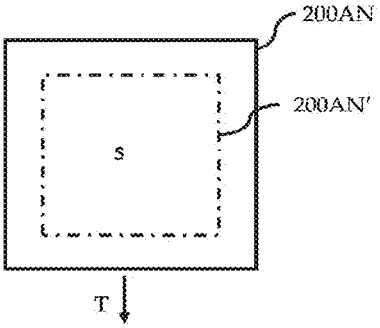
FIG. 2E
FIG. 2F
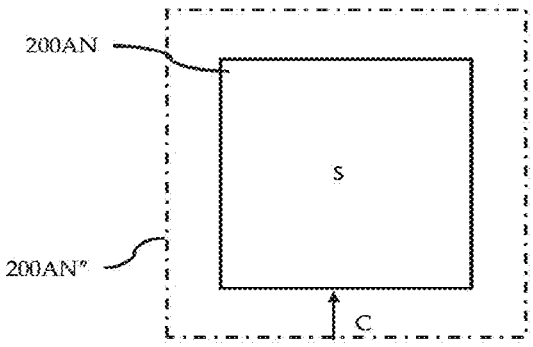

300A

300B

300C

T
T
T

300A

300B

300C

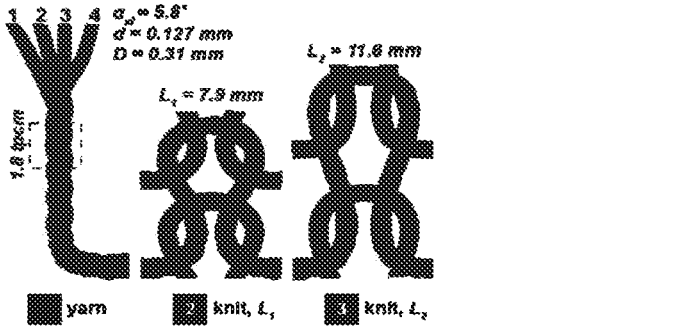
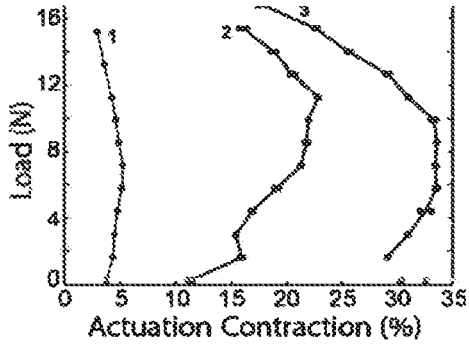
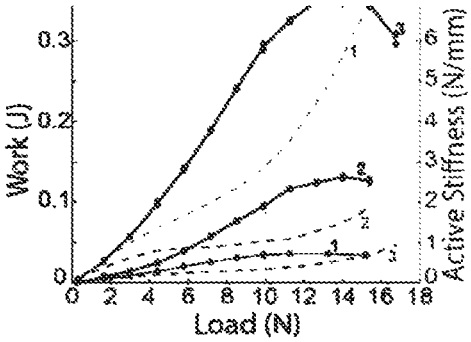
FIG. 5E-1

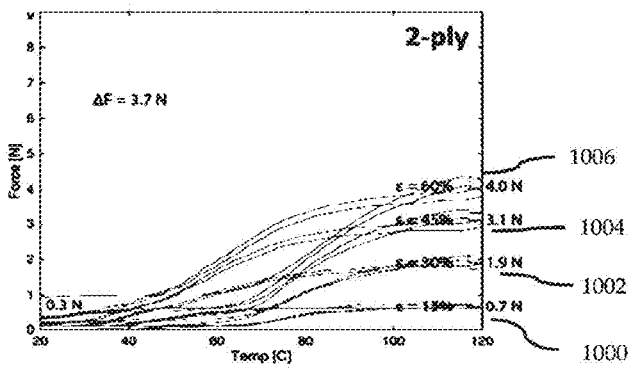
FIG. 10A
FIG. 10B
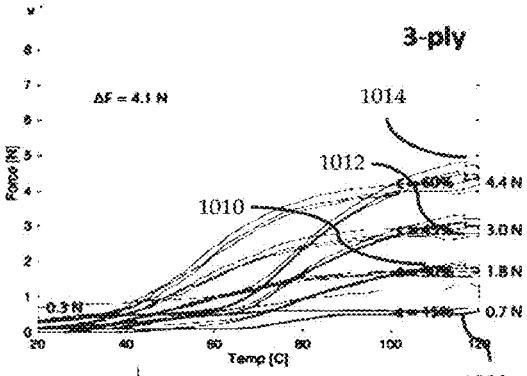
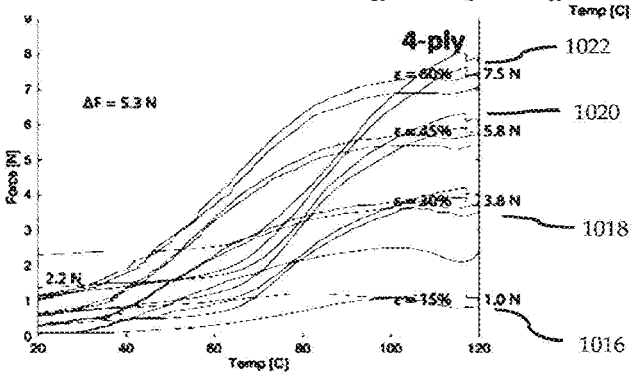
FIG. 10C

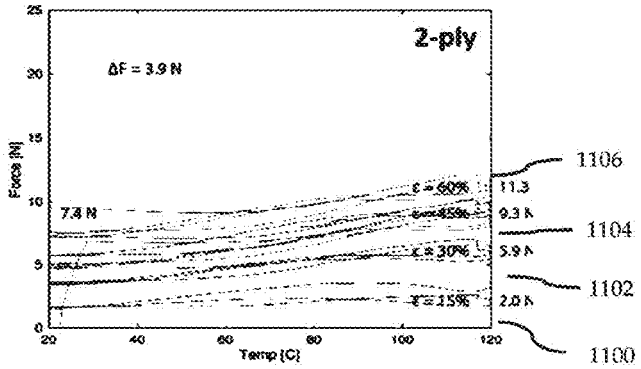
FIG. 11A
FIG. 11B
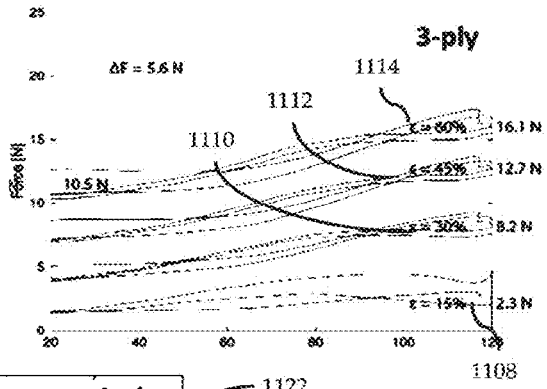
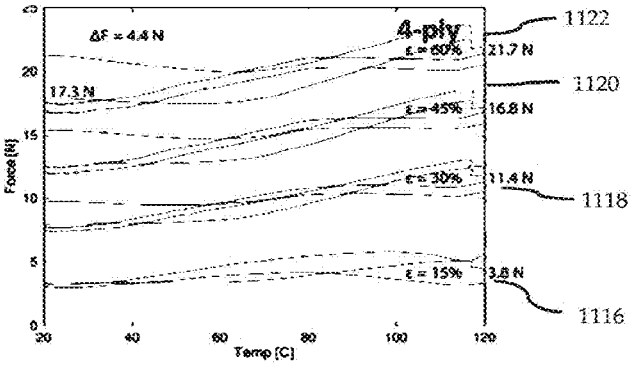
FIG. 11C

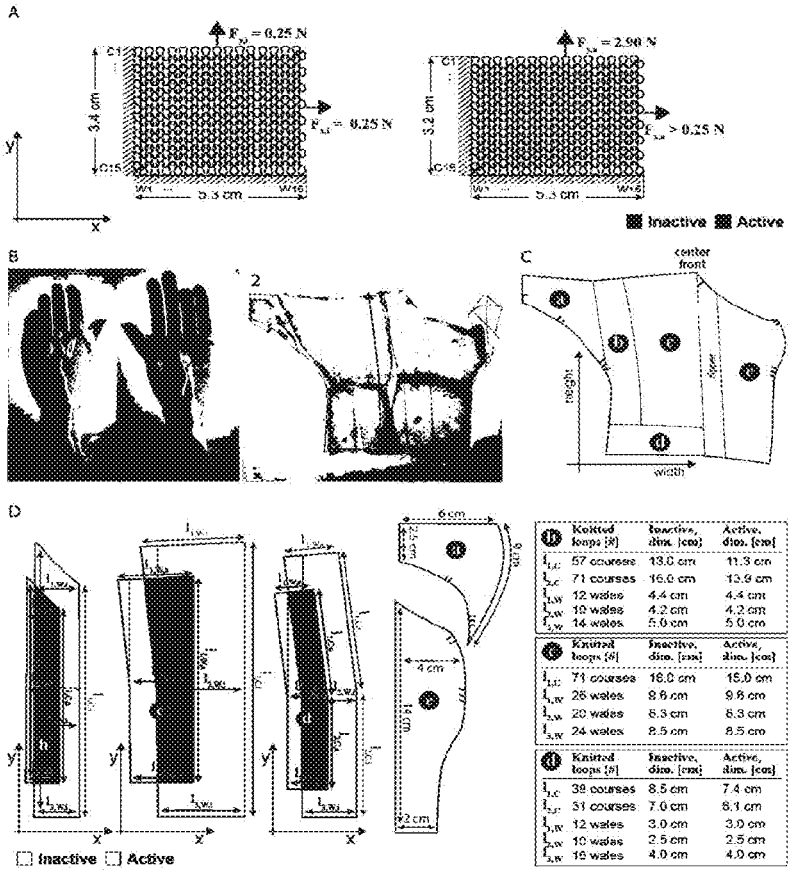

| ❶ | Knitted loops [#] | Inactive, dim. [cm] | Active, dim. [cm] |
|---|---|---|---|
| $l_{1,c}$ | 57 courses | 13.0 cm | 11.3 cm |
| $l_{2,c}$ | 71 courses | 16.0 cm | 13.9 cm |
| $l_{1,w}$ | 12 wales | 4.4 cm | 4.4 cm |
| $l_{2,w}$ | 10 wales | 4.2 cm | 4.2 cm |
| $l_{3,w}$ | 14 wales | 5.0 cm | 5.0 cm |

| ❷ | Knitted loops [#] | Inactive, dim. [cm] | Active, dim. [cm] |
|---|---|---|---|
| $l_{1,c}$ | 71 courses | 16.0 cm | 15.0 cm |
| $l_{1,w}$ | 26 wales | 9.6 cm | 9.6 cm |
| $l_{2,w}$ | 20 wales | 8.3 cm | 8.3 cm |
| $l_{3,w}$ | 24 wales | 8.5 cm | 8.5 cm |

| ❸ | Knitted loops [#] | Inactive, dim. [cm] | Active, dim. [cm] |
|---|---|---|---|
| $l_{1,c}$ | 39 courses | 8.5 cm | 7.4 cm |
| $l_{2,c}$ | 31 courses | 7.0 cm | 6.1 cm |
| $l_{1,w}$ | 12 wales | 3.0 cm | 3.0 cm |
| $l_{2,w}$ | 10 wales | 2.5 cm | 2.5 cm |
| $l_{3,w}$ | 16 wales | 4.0 cm | 4.0 cm |

FIG. 25B

MULTIFUNCTIONAL ACTIVE YARNS AND TEXTILES

This invention was made with government support under 80NSSC17K0158 awarded by NASA. The government has certain rights in the invention.

CROSS-REFERENCE TO RELATED APPLICATION

Aspects of the embodiments and techniques described herein are described in U.S. Provisional Application Ser. No. 62/942,582 filed on Dec. 2, 2019, the disclosure of which is hereby incorporated by reference in its entirety.

TECHNICAL FIELD

Embodiments described herein relate to fibers and composites or yarns thereof that can produce functional effects. Additionally, embodiments relate to fabrics and garments produced from such materials, and methods of making such materials, fabrics, and garments. Some embodiments described herein relate to bundles, composites, or yarns that provide novel tension profiles across or within fabrics or garments made thereof.

BACKGROUND

Textiles are age-old hierarchical assemblies that exploit the mechanical characteristics of a single fiber through 1D yarn construction and 2D textile geometry to produce highly tunable surface properties. The use of knitted and netted materials to dissipate, absorb, and generate force is used across a variety of industries, including aerospace, sports, law enforcement, military, construction, automotive, medical device, and medical prosthesis.

Textile assembles have traditionally been used to distribute a material across a surface for functions such as thermal insulation and moisture protection. In one example, compression garments can provide effective medical treatment for disorders ranging from varicose veins and lymphedema to orthostatic intolerance and deep vein thrombosis. Some characteristics of knitted materials can improve impact tolerance and provide drape properties to devices used in aerospace, professional sports, law enforcement and military, construction and automotive industries, as well as medical devices to facilitate physical therapy.

Rather than extending the physical properties of the material continuously in sheet formation, textile assemblies leverage a hierarchy of structures designed to modify the flexibility, conformability, and breathability of the base material. This assembly of mechanical structures has recently inspired innovation in the field of smart materials. Functional fibers, yarns, and textiles that exhibit actuation, sensing, color change, and energy harvesting capabilities can enable a new classes of lightweight, compact, and flexible technologies for applications such as wearable electronics, dynamic camouflage, and soft robotics.

A first type of conventional use for knitted materials is in garments, such as compression garments used for medical therapies. Conventional compression garments for medical applications, relying upon the use of under-sized garment technologies, may aid in relief of medical conditions, but also exhibit limited usability. Fixed levels of compression in elastic materials may induce challenges in donning/doffing, complicating patient compliance. The cross-section of the garment, when the elastic garment is in a relaxed state, is smaller than a particular cross section of the body. When applied, the garment stretches and exerts force as the elastic contracts back toward its relaxed state. Other types of non-elastic, undersized compression technologies include oversized garments that can be made undersized by reducing the garment circumference after the garment has been donned by adjustable mechanisms, such as lacing, buckles, hook and loop tape, or straps.

Under-sized garments apply a substantially constant pressure on the portion of the user's body at each particular point. Depending on the user's anatomy, however, the amount of pressure can vary along the length of the garment. Although under-sized garments can be designed to provide substantially uniform pressure (or a desired pressure gradient) to a typical person, variations in user anatomy can result in variation from the intended pressure profile for that garment.

Another type of compression garment relies on inflation of a garment. In aerospace medicine, for example, orthostatic intolerance garments (OIG) are a type of compression garment that acts as a countermeasure to, and treatment for, the high gravitational load experienced during astronaut reentry and landing on earth that otherwise can disrupt the body's mean arterial pressure, cause blood to pool in the lower limbs, and make cerebral perfusion difficult to maintain without external assistance.

In addition to medical context, garments with compression features have been used for aesthetic reasons. Aesthetics can be a key factor in adoption of a garment by consumers or by a patient who would benefit from wearing a compression garment, as poor design leads to dissatisfaction and noncompliance. Even where no therapeutic level of compression is needed, "athleisure" clothing has become popular, including which garments that exhibit some compressive force and are made to be stylish, form fitting, or shaping, as well as comfortable. Examples include leggings or active footwear, for example.

The pressure profile created by a garment (whether used for a medical or aesthetic purpose) can vary based upon the way in which it is used. The cross-sections of various body parts change depending upon whether the person is seated, standing, or lying down. Therefore, an under-sized garment, which typically cannot be resized or reshaped depending on the user's activity level or body position, may apply different levels of compression for users with different levels or types of activity.

Each of these types of compression garments presents different technical challenges. Undersized compression garments do not provide tailored compression and can be too tight or too loose (or both, depending on the area), while inflated compression garments and knitted shape-memory garments require a supply of power to actuate the compression system and also typically a feedback system to monitor pressure.

Pneumatic and undersized compression garments are currently available to the consumer population for treatment of conditions such as postural orthostatic tachycardia syndrome (POTS). Compression can also be an effective medical treatment for disorders ranging from varicose veins and lymphedema to orthostatic intolerance and deep vein thrombosis. Inflatable garments provide effective, medically therapeutic pressures to the body. These inflatable garments such as leg sleeves are bulky, tethered to an inflation source, and inhibit joint mobility. Undersized CGs are a more practical solution for POTS patients, who are predominately symptomatic during periods of activity. Elastic knit stockings are low-profile and do not inhibit mobility, but they can exert unpredictable pressures and physicians report a high level of non-compliance amongst patients due to donning difficulties and reported discomfort.

In sum, conventional compression garments such as elastic compression sleeves and inflatable compression systems may aid in relief of these conditions but are also limited in usability. Fixed levels of compression in elastic materials may induce challenges in donning/doffing, complicating patient compliance. Conventional compression garments rely upon either under-sized or inflatable compression technologies. Under-sized elastic garments are typically associated with a particular portion of a user's body, such as a calf or forearm. The cross-section of the garment when relaxed is smaller than the cross-section of the portion of the body. When applied, the garment stretches and exerts force as the elastic contracts back towards its relaxed size. Other types of non-elastic, undersized compression technologies include oversized garments that can be made undersized by reducing the garment circumference after the garment has been donned by adjustable mechanisms, such as lacing, buckles, hook and loop tape, or straps.

Therefore, while compression garments are relatively inexpensive and effective at providing static medical compression, they suffer from problems with ease of use. Furthermore, they are typically limited to use for one particular body part (e.g., an ankle or wrist) and suffer from decreasing elasticity over time and are unable to accommodate changes in patient needs over time, such as those caused by weight gain or loss or, in the context of a physical therapy support, change in patient strength.

Knitted and netted materials have unique properties, compared to woven or two-dimensional laminate materials, for example. Knitted fabrics are generally made from a single fiber or yarn, shaped into a network of interconnected loops or stitches. Whereas woven materials exhibit minimal deformation when a stress is applied, knitted materials can deform in three dimensions, and as a function of the specific properties of the yarn used, the techniques applied to construct the yarn, and the combination of knit stitches throughout the knitted material.

Fabric construction has a large influence on function, specifically through the density of the knitted material. Loose knit materials allow more air circulation and thermal regulation than dense knit materials. Dense knit materials provide protection against climatic influences, and provide greater mechanical strength. Density of a knitted material is highly influenced by the elastic properties and thickness of the yarn, gauge of the knit stitches, and knitting technique used.

The use of weft and warp knitting techniques influence the stretch and bi-stretch of resulting knitted materials. When weft knitting is used, stretch occurs along a horizontal plane (i.e. course) of the knitted material, whereas warp knitting confers stretch along a vertical plane (i.e. wale) of the knitted material. Weft knitting is typically characterized as very elastic with high shrinkage, with comparatively low tensile strength and a resulting thin knitted material. In comparison, warp knitting is typically characterized as having lower elasticity and shrinkage, with comparatively higher tensile strength, and a resulting course knitted material. Weft knitting is accomplished by combining knit and purl stitches, either through the back of loop or front of loop, in a pattern to achieve a final material with desired elastic and stretch properties. Common weft knit stitch patterns include rib stitch, garter stitch, stockinet stitch, linen stitch, reverse ridge stitch, and cables.

Similar to the use of knitting techniques, netting results in a material that has elasticity, ability to deform along three dimensions, and are influenced based on the specific properties of the yarn used, the techniques applied to construct the yarn, and the combination of knit stitches throughout the knitted material. Conventional netted materials are produced by a Ceylon stitch, nålbinding stitches (e.g. York, Oslo, Mammen, Finnish stitches), Diamond Loop stitch, or other stitch patterns.

For both knitted materials and netted materials, the use of yarn ply, including ply technique, influences the properties of the final material. Materials constructed from single ply (e.g., monofilament) yarns have different properties than materials constructed from two- or three-ply yarns, and so on. The number of twists per inch when plying filaments together also influences the properties of a finished knitted material or netted material in ways that are not easily quantifiable or predictable.

For both knitted materials and netted materials, the choice of yarn material will influence elasticity, stretch, drape, and strength. It is possible to combine one or more types of material in a single ply or, alternatively, combine one or more different plies together in a single yarn. In doing so, the end knitted material or netted material takes on the combined properties of the individual ply materials, which can be enhanced or reduced by the use of different knitting and netting techniques and stitch combinations. This combination of knitting and netting techniques, yarn ply techniques, and yarn material can all be combined to produce a functional fabric that can provide benefits to an end user. Woven and laminated materials do not, however, solve the problems with compression garments or other functional fabrics described previously, because they are largely static structures that exhibit limited compression, and still must be significantly deformed from their state at rest before they can be donned or doffed.

Active textiles, or textiles that exhibit mechanical actuation, have been proposed to advance multifunctional textile applications. On-demand tunability of a textile's mechanical properties, dynamic variation in surface topography, as well as macroscopic shape change can enable a wide range of innovations across industrial, biomedical, consumer, and aerospace domains, including variable-stiffness human-system interfaces, morphing compression garments, lunar activity space suits, self-fitting clothing, compact and conforming haptic interfaces, and mobility assistance devices.

Functional fabrics can provide visual or auditory output, or they can be used for energy storage and conversion, or to monitor health or activity of a wearer. Functional fabrics can also include components of heated garments that convert some type of energy, such as electrical energy stored in a battery, into thermal energy. Conventionally, wires, leads, or sensors can be inserted into fabrics, or fabrics can be formed around such objects, to provide the ancillary benefit of the functional fabric.

Shape memory alloys and other "smart" or superelastic materials can be electrically controlled as a means to induce thermo-mechanical transformation which transforms a less-stiff material to an activated, higher-stiffness material in a functional fabric. These states are referred to as martensite and austenite, respectively. For example, knitted garments or netted garments of shape memory material can provide compression in a desired area, dissipate or absorb or generate force, or facilitate movement in a specific direction. Known functional fabrics based on shape memory effect transitions, but the use of a particular active material filament in a knitted pattern results in a corresponding, single function so that such functional fabrics are tuned for a specific purpose. Functional fabrics incorporating shape memory materials and can require carrying a power source, and operate in a known way at a specific activation temperature. These materials are therefore inappropriate for garments that must perform more complex tasks, such as responding to impact, or exerting or absorbing forces that vary in location, intensity, and timing.

Active materials are increasingly capable of providing sufficient output of desired properties or output capacities (e.g., force, work, or displacement) that they are considered for applications other than in garments, as well. In general, it would be desirable to be able to selectively enhance these output capacities, or multiple ones of these output capacities. While some of these output capacities can be increased by using materials that exhibit higher stresses and larger actuation performance, or by increasing either the number or the cross-sectional size of the active material itself, these solutions have limited potential or practicality.

As described above, fabricating knitted materials can create effects that are different from those of the bulk material, but these higher-level effects are not easily predictable. It is thought that features such as the size of fibers, knitting/braiding/stitching pattern, overall garment shape, level of friction between fibers, material makeup of fibers, forces on the fibers during fabrication, and forces on the fibers during activation could all affect behavior of the material in some way, but no overarching model describes this behavior.

SUMMARY

As described herein, active garments or fabrics can include "yarns" or multi-filament bundles of active materials to produce a variety of effects. The materials within the yarns described herein can have different transition temperatures, different shape memory effects, different thicknesses, and different individualized twists. Additionally, the superstructure of the yarn itself can be tuned to accomplish a desired effect, such as by modifying the number of plies in the yarn, the number of twists per unit length of the yarn, and the pattern into which the yarn is knitted, for example.

By varying aspects of both the individual plies and also the yarn structure, as well as the knitting, netting, or weaving pattern in which the yarn is used, a variety of new and useful properties can be generated.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which:

FIGS. 2A-2F depict compression and tension characteristics of traditional, auxetic, and active negative Poisson's ratio materials under tension and compression, according to embodiments.

FIGS. 5E-1 and 5E-2 show amplified actuation contraction and work outputs of a yarn as depicted in FIGS. 5A-5D.

FIGS. 10A-10C show force as a function of temperature for embodiments of textiles composed of spun yarns with 2 plies, 3 plies, and 4 plies, respectively.

FIGS. 11A-11C show force as a function of temperature for embodiments of textiles composed of spun yarns with 2 plies, 3 plies, and 4 plies, respectively, and in which the diameter of each filament is increased as compared to FIGS. 10A-10C.

FIGS. 25A and 25B show an active fabric wrist support, according to an embodiment.

Figure 1A:
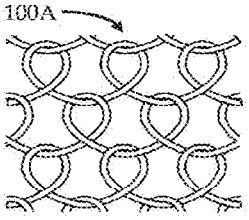
FIGS. 1A-1C depict the contraction of a shape memory filament in a needle lace pattern with buttonhole stitches, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The problems described above related, including ease of use, maintaining desired compression levels over time, and generating complex and tunable effects, are solved by the use of garments that are capable of absorbing force, releasing force, and producing desired displacement anisotropically. Several of the concepts required for a full understanding of the instant application are described in detail in the commonly-assigned PCT application published as WO 2019/108794, the contents of which are incorporated by reference herein in their entirety.

The following terms are used throughout this application to refer to specific properties that are generated by the yarns and structures described herein.

Filament/Fiber. The terms "filament" and "fiber" are used interchangeably herein to describe a single, continuous strand of material. In embodiments, filaments or fibers may be made of either an active material or a passive material and may be continuous fiber filaments or shorter staple fibers.

Yarn. Yarns are structures made of multiple filaments or fibers. The number of filaments or fibers in the yarn is referred to as the "ply" of the yarn.

Fabric/Garment. Fabrics are structures made of multiple yarns, filaments, or both. A fabric described herein may be a knitted structure of several yarns that, in combination, are designed to produce a desired effect when a transition occurs among some or all of the functional materials therein. Functional fabrics may be part or all of a functional garment, in embodiments.

Force, Displacement, Pressure, and Work. The terms "force," "displacement," and "work" are used in their conventional meaning to a person having skill in the art of materials science or kinematics.

Force is a fundamental physical concept referring to an interaction that promotes acceleration on a mass. Force is typically expressed in SI units of Newtons (N).

Displacement refers to a distance traveled. Application of force can cause a corresponding displacement (e.g., the distance that a spring is compressed when a force is applied is referred to as the displacement of the spring).

Pressure is related to force, in that pressure is an application of force across an area. Pressure has SI units of Newtons per square meter. In the context of garments, pressure can be thought of as the tightness of the garment. Depending on the intended use for a particular garment, it may be desirable to have medical/therapeutic levels of pressure, or it may be desirable to minimize pressure while ensuring a high level of fit (i.e., high displacement, low pressure).

Work is used herein in its kinematic sense: the integral of force over displacement. Work can therefore be increased by increasing the level of displacement, for example. On the other hand, a higher applied force can do more physical work even while moving along the same displacement.

Blocked force is defined as the forces that are produced when displacements are inhibited. In the context of garments, blocked force is produced when an active material is wrapped around the body such that displacements are inhibited by the body circumference. When the active material is actuated (and undergoes a phase or volume change that otherwise would produce displacement), inhibited displacements translate to a change in force around that body cross-section.

Actuation contraction (( ) can be calculated from a force-control procedure and defined as the engineering strain between the actuator length in an active material state and the actuator length in an inactive material state:

$$\zeta = \frac{l_i - l_a}{l_i} \times 100$$

Mechanical work can be calculated from a force-control procedure according to actuator displacement ($l_i$–$l_a$) in meters and applied load (F). The specific work can be calculated in relation to actuator mass (m):

$$\text{Specific work} = \frac{l_i - l_a}{m} \times F_{app}$$

Active and Inactive Force. Within a yarn or a garment (or even on a fiber or filament within these structures), there may be forces that are present. When the materials of a fabric or garment are in an inactive state, these forces are referred to as "inactive forces." Inactive forces are found in nearly all conventional, knitted materials. "Active" forces, on the other hand, occur as a result of a shape memory or superelastic transition. Such active forces can be generated, for example, by a change in temperature, electrical charge, current, light, pH or other chemical contact, or applied force. "Active" forces are generally reversible at will by removing the stimulus that created them, subject to hysteresis effects, which makes them quick to actuate or deactivate. As an active material within a garment transitions, additional forces may be applied both to that material and to others within the fabric or garment.

Total active force gathered from a displacement-control procedure is the force-observed while the actuator was in an active material state (T=120° C.). Generated force (Δf) is calculated as the difference between the actuator force in inactive and active material states ($f_a$, $f_i$).

$$\Delta f = f_a - f_i$$

A more complete understanding of the transitions possible via active materials, and resultant phenomena, can be found in the previously-filed PCT application PCT/US2018/063066 (published as WO 2019/108794 on Jun. 6, 2019), the contents of which are incorporated in their entirety. For example, the force/length diagram of FIG. 3 of the incorporated reference is representative of first-order effects in an active material, while FIGS. 4A-8 show second and third-order effects, and FIGS. 9-12 and 23A-28C show third-level (or system-level) effects.

Auxetic. The term "auxetic" refers to a structure or material that expands in directions perpendicular to an applied tensile force or contracts in directions perpendicular to a compressive force (i.e., has a negative Poisson's ratio). Auxetic materials described herein are referred to as 'active auxetic', meaning that a non-contact stimulus (i.e., no applied forces) can be used to cause a structure or material to contract bi-axially or expand biaxially. Active auxetic structures and materials herein may include filaments, yarns, or entire fabrics or garments.

Compression Garment. A garment that exhibits sufficient compression (i.e., force per unit area) to accomplish medical, therapeutic treatments such as treatment of postural orthostatic tachycardia syndrome (POTS) or treatment of circulatory or lymph conditions, for example.

Self-fitting. A garment herein is referred to as "self-fitting" garment if it is designed to contract to an accurate fit for the wearer. Self-fitting garments may be compression garments, but need not provide medical or therapeutic levels of compression in all instances. The level of force applied by a self-fitting garment should, in many cases, be smaller than that of a therapeutic compression garment, while the total displacement should be larger. Other garments, fabrics, or portions thereof can be made of "passive" material, which refers to materials that do not exhibit a shape-memory transition.

First-Order Effects. As used herein, a first-order effect is one that affects a single fiber or filament. For example, a single filament or fiber may be designed to perform a particular effect upon transition from martensite to austenite or vice versa. A single fiber or filament may also be twisted or coiled to exhibit a first-order effect. The material filament composition—the foundation of the hierarchy—can determine the base mechanical properties of an entire textile. Active properties, such as variable stiffness and shape recovery, can be embedded within the textile hierarchy through the inclusion of an active filament, such as a hydrogel or shape memory polymer (SMP) filament, or active bimorph/composite filament.

Second-Order Effects. A second-order effect is an effect caused by the interaction between multiple filaments arranged in a yarn. Yarns that include multiple plies, twist styles or tightness, and materials can exhibit second-order effects that occur upon activation of any functional elements therein. Traditional material filaments, such as silk, cotton, polyethylene, and nylon, have also been shown to accomplish linear and torsional actuation in yarn constructions through thermally- or hygroscopically-induced fiber volume increase. This approach is highly adaptable and illustrative of the functional flexibility of textile hierarchies.

Yarn spinning alters the mechanical properties of the original material filament by pre-stressing and constraining the materials in a helical geometry. The design parameters for a continuous filament yarn, including the number of bundled filaments and the applied twist per unit length, tune the flexural rigidity, breaking strength, and strain elongation of the yarn. When active filaments, such as carbon nanotubes (CNT), shape memory alloys (SMA), and polymers, are reconfigured into yarn constructions, often called artificial muscles, the properties of the active filament are modified and even imbued with new capabilities, such as torsional actuation.

In embodiments the filament can be incorporated into a yarn, which is a combination of filaments. Alternatively, in embodiments the filament can be incorporated into a thread, which comprises multiple yarns or filaments bound in a braid pattern. Each of the filaments that make up a yarn or a thread can be a functional filament, or in embodiments functional threads can be interspersed among non-functional filaments.

Third-Order Effects. Third-order effects are the cumulative effects of first- and second-order effects when filaments and/or yarns are combined into a fabric or garment. The multi-level hierarchy of textiles including first, second, and third-order effects can be thought of as material filament composition, yarn construction, and textile geometry, for example. Complex third-order effects can be system architecture level effects, generating active textile structures with enhanced programmability and scalability, using ubiquitous manufacturing techniques and infrastructure.

The mechanical characteristics of active filaments and yarns can be further tuned by reconfiguring these 1D elements into 2D textile geometries, such as weaves, knits, or braids, to produce lightweight, compact, and conformal actuation across a scalable and distributed surface. Woven and braided textile geometries, which are opposing rows of interlocked filaments or yarns, aggregate active 1D elements to produce a scalable and distributed surface that closely resembles the mechanical characteristics of the single active 1D element. Alternatively, knitted textile geometries, which are loop-based structures, have been shown to behave like origami tessellation patterns, embedding variable surface topography and shapes into the textile geometry. Active filaments reconfigured into weft knit geometries can accomplish complex actuation motions, include folding, curling, contraction, and corrugation. When wrapped around volumetric forms, 2D active textiles can be reconfigured into 3D system architectures with complex and dynamic behaviors.

Use of a variety of fabric components of patterns can create garments that improve upon existing compression garments by providing features such as a passive tension-feedback system incorporated in series with embedded shape memory alloy filaments, or filaments made of other smart materials that can transform between an active, constrictive state and a passive, loose state upon a controlled change in stimulus (e.g., temperature, magnetic field). The resulting smart fabric will undergo shape memory change to provide compression only when the tension in the active component is below a threshold. In the event that the level of compression in a portion of the garment exceeds the threshold, "circuit breaker" switch elements in the garment disconnect the electrical power from that portion of the garment, which stalls resistive heating until the portion of the garment has cooled and relaxed sufficiently to reduce the tension to a desired level.

In some embodiments, the shape memory alloy elements are configured to change between martensite and austenite forms upon donning the garment, based on ambient conditions. For example, in some embodiments exposure to room temperature causes the garment to change from martensite to austenite. Alternatively, in other embodiments exposure to skin temperature is sufficient to cause the garment to change from martensite to austenite. The shape memory transition causes compression of the garment, such that an initially loose-fitting garment will become a compression garment that is tight fitting up to, and including, tight enough to act as a clinical compression garment.

Materials are described herein that can be used to generate active fabrics, including fabrics that include active components in specific locations. Filaments are described herein that include multiple heterogeneous portions, at least some of which are made of active materials. Active materials are those that have some active or functional properties, such as actuatable mechanical components (e.g., piezoelectrics, electro-mechanical components, thermo-mechanical components, and shape memory materials), electrically functional components (e.g., conductive, semiconductive, or photoelectric materials), or actuatable thermal components (e.g., materials that undergo exothermic or endothermic reactions upon exposure to stimulus, or electrically resistive materials that produce heat upon exposure to an electrical potential).

In embodiments, functional fabrics can be manufactured from multi-material or heterogeneous filaments. The multi-material filaments can be additively manufactured to create transitions between materials within a short distance relative to the loops of the knitted structure. Thus fabrics can be created from filament such that the fabric has precisely placed features. The precisely placed features can include electrically conductive or insulative portions, shape-memory portions, piezoelectric portions, elastic or inelastic portions, and any other mechanical, electrical, or thermal features.

By additively manufacturing the filament, functional features can be integrated into the fabric that have different physical characteristics compared to a functional fabric that is additively manufactured in situ. For example, each of the yarns, threads, or filaments of a knitted material that is additively manufactured in situ will be unstressed in the absence of some outside force acting upon the fabric. In contrast, when a yarn, thread, or filament is integrated into a knitted structure, the yarn, thread, or filament is deformed into loops to fit into the structure of the rest of the fabric. This deformation results in tension on each individual yarn, thread, or filament, even when the overall fabric is not being acted upon by any external force. Therefore, a knitted active fabric behaves differently from one that is built in place by an additive manufacturing machine, which cannot form objects that are under tension in their resting state.

By incorporating yarns in functional fabrics, force, displacement, and third-order effects can be tuned for desired first-order functional effects.

Third-Order Effects Using Filaments and Fibers

Functional textiles with programmable, multi-axial, distributed, and scalable actuation are highly desirable and presently unrealized. As noted above, third-order effects can be generated by varying the size of fibers used, knitting/braiding/stitching pattern, overall garment shape, level of friction between fibers, material makeup of fibers, forces on the fibers during fabrication, and forces on the fibers during activation, but no overarching model describes this behavior. As described herein, however, use of 1D torque-unbalanced active yarns within 2D textile structures can produce desired materials such as soft and scalable active textiles that exhibit tunable displacements, forces, stiffnesses, and kinematic deformations.

While recent advances in active textiles have focused on active yarns (e.g., artificial muscles), investigations into multi-level textile hierarchies are rare. Prior work examining active yarn constructions reconfigured into textile geometries have been limited to work with torque-balanced active microfilament bundles, which accomplish axial actuation only and contain thousands of active filaments (nf>1000). Until now, no multi-scale, mechanics-based investigation of textile geometries and system architectures has been performed that exploits unique and unpredictable characteristics of torque-unbalanced 1D active yarns composed of few filaments (nf<7) that accomplish axial and torsional actuation as described herein. These structures are shown to accomplish new, multi-scale kinematic motions by exploiting the structural elastic instability of active filaments in pure torsion.

This new kinematic motion is shown to enhance the performance of active textiles, amplifying actuation contraction, specific work, and blocked force compared to active textiles composed of untwisted filaments. Additionally, these active textiles accomplish new modes of multi-functional and spatial actuation, including variable recruitment actuation, functionally graded kinematic actuation, and active auxetic effects.

Variable recruitment actuation is the result of second-order effects in yarn constructions containing a mix of active filaments (each having its own first-order effect) to enable multi-step actuation regimes. Functionally graded kinematic actuation (a third-order effect) is accomplished by strategically selecting/deselecting different yarn constructions within a single textile to produce tuned and localized mechanical properties throughout a continuous textile surface. Active auxetic effects are accomplished through the addition of filament torsion, which produces controllable structural buckling and introduces axial actuation in both axes of a 2D structure.

Active auxetic effects can produce structural anisotropy, enabling unique actuation performance across both perpendicular axes. Through a textile hierarchical spanning active material composition, yarn construction, textile geometry, and system architecture, these active textiles accomplish kinetic tunability, variable recruitment behaviors, and auxetic effects without mechanical contact, called active auxetic effects. These new modes of pre-programmed multi-axial performance are enabled by geometrically manipulating—specifically pre-stressing and constraining—active filaments in torsion and leveraging their structural elastic instability within a textile geometry. Experimental data illustrates that the new kinematic motion afforded by torque-unbalanced active yarns enhances the performance of active textiles, which accomplish tensile strokes over 40%, generated blocked forces up to 308 N/m, and specific work over 0.4. kJ/kg.

Figure 1B:
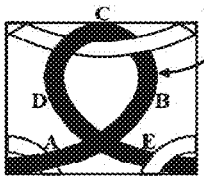
Figure 1C:
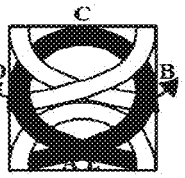

FIGS. 1A-1C depict the contraction of a series of shape memory filaments in a needle lace pattern 100A with buttonhole stitches, according to an embodiment. FIG. 1A shows an un-tensioned, unactivated needlelace pattern, with the material in the martensitic state. FIG. 1B is a detailed view of one loop of the overall pattern depicted in FIG. 1A. Five specific points A-E are shown on an individual filament 102A in FIG. 1B. Upon activation of the shape memory material that makes up filament 102A, the overall fabric of the knit pattern 100A contracts biaxially due to the interactions between the fibers, as illustrated by the displacement of the five specific points A-E in FIGS. 1B and 1C.

Figure 1D:
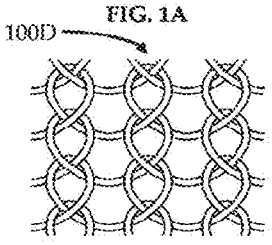
FIGS. 1D-1F depict the contraction of a shape memory filament in a needle lace pattern with Ceylon stitches, according to an embodiment.
Figure 1E:
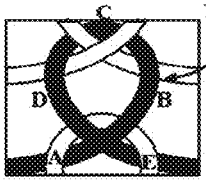
Figure 1F:
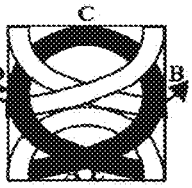

FIGS. 1D-1F depict the contraction of a shape memory filament in a needle lace pattern 100D with Ceylon stitches, according to an embodiment. FIGS. 1D-1F show a similar second-order effect to the one described in FIGS. 1A-1C. FIG. 1D shows an un-tensioned, unactivated needlelace pattern 100D, with the material in the martensitic state. FIG. 1E is a detailed view of one loop of the overall pattern depicted in FIG. 1D. Five specific points A-E are shown on an individual filament 102D in FIG. 1E. Upon activation of the shape memory material that makes up filament 102D, the overall fabric of the knit pattern 100D contracts biaxially due to the interactions between the fibers, as illustrated by the displacement of the five specific points A-E in FIGS. 1E and 1F.

Figure 1G:
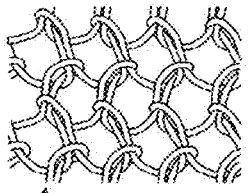
FIGS. 1G-1I depict the contraction of a shape memory filament in a weft knit pattern with Ceylon stitches, according to an embodiment.
Figure 1H:
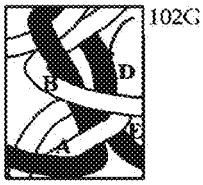
Figure 1I:
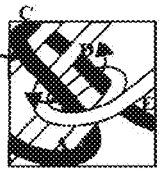

FIGS. 1G-1I depict the contraction of a shape memory filament in a weft knit pattern 100G with Ceylon stitches, according to an embodiment. FIGS. 1G-1I show a similar second-order effect to the one described in FIG. 1A-1C or 1D-1F. FIG. 1G shows an un-tensioned, unactivated knit pattern 100G, with the material in the martensitic state. FIG. 1H is a detailed view of one loop of the overall pattern depicted in FIG. 1G. Five specific points A-E are shown on an individual filament 102G in FIG. 1H. Upon activation of the shape memory material that makes up filament 102G, the overall fabric of the knit pattern 100G contracts uniaxially due to the interactions between the fibers, as illustrated by the displacement of the five specific points A-E in FIG. 1H and 1I.

Figure 1J:
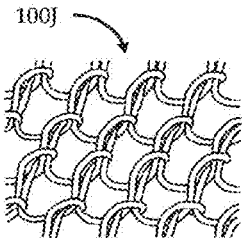
FIGS. 1J-1L depict the contraction of a shape memory filament in a weft knit pattern with unbalanced Ceylon stitches, according to an embodiment.
Figure 1K:
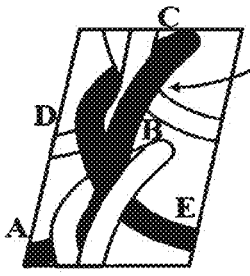
Figure 1L:
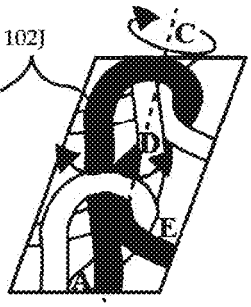

FIGS. 1J-1L depict the contraction of a shape memory filament in a weft knit pattern with unbalanced Ceylon stitches, according to an embodiment. FIGS. 1J-1L show a similar second-order effect to the one described in FIG. 1A-1C, 1D-1F, or 1G-1I. FIG. 1J shows an un-tensioned, unactivated knit pattern 100J, with the material in the martensitic state. FIG. 1K is a detailed view of one loop of the overall pattern depicted in FIG. 1J. Five specific points A-E are shown on an individual filament 102J in FIG. 1K. Upon activation of the shape memory material that makes up filament 102K, the overall fabric of the knit pattern 100J contracts biaxially due to the interactions between the fibers, as illustrated by the displacement of the five specific points A-E in FIGS. 1K and 1L.

Figure 1M:
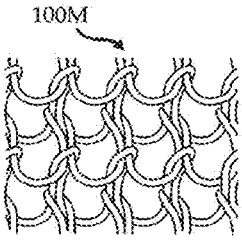
FIGS. 1M, 1N, and 1P depict the contraction of a shape memory filament in a garter knit pattern with twisted filaments, according to an embodiment.
Figure 1N:
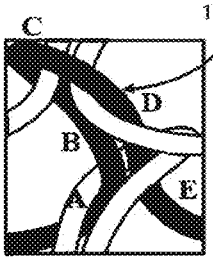

FIGS. 1M-1P depict the contraction of a shape memory filament in a garter knit pattern 100M with twisted filaments, according to an embodiment. FIGS. 1M-1P show a similar second-order effect to the one described in FIG. 1A-1C, 1D-1F, 1G-1I, or 1J-1L. FIG. 1M shows an un-tensioned, unactivated knit pattern 100M, with the material in the martensitic state. FIG. 1N is a detailed view of one loop of the overall pattern depicted in FIG. 1M. Five specific points A-E are shown on an individual filament 102M in FIG. 1N. Upon activation of the shape memory material that makes up filament 102M, the overall fabric of the knit pattern 100M contracts biaxially due to the interactions between the fibers, as illustrated by the displacement of the five specific points A-E in FIGS. 1N and 1P.

Figure 1P:
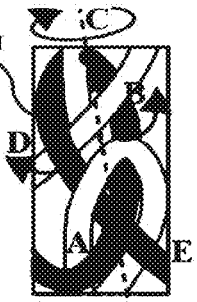

As shown in FIGS. 1A-1P, the knitting pattern selected can influence the contraction of the overall fabric, even when the same filaments or fibers having similar shape memory effects are used.

Understanding the effect that a single stitch type has in a fabric can be used to inform a designer's choices for the overall pattern of a garment or other knitted material. For example, one desired second-order effect could be to create a particular pattern of contraction or expansion within the fabric or garment itself, as described in WO 2019/108794 at FIGS. 4A-15C. In such patterns, different knit patterns, as well as the use of both shape-memory and passive filaments, lead to desired contraction patterns when the garment is activated.

In addition to the types of second-order effects described in WO 2019/108794, a designer may wish to create an auxetic effect. Auxetic effects can be either first-order, auxetic transitions of shape-memory filaments or fibers, or they can be third-order, auxetic changes in the overall fabric. FIGS. 2A-2F depict possible auxetic third-order effects for a simplified schematic square of fabric.

Figure 2A:
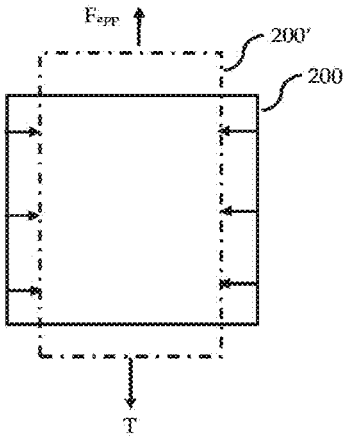

FIG. 2A depicts a square fabric 200 in solid line. FIG. 2A further depicts, with the downward-pointing arrow, the application of tension on square fabric 200. As a result of the application of tension T due to force applied $F_{app}$ on fabric 200, the shape of fabric 200 becomes narrower and taller, with respect to the orientation depicted on the page. This is a response that would be typical for a material with a positive Poisson's ratio. In other words, square fabric 200 is non-auxetic.

Figure 2B:
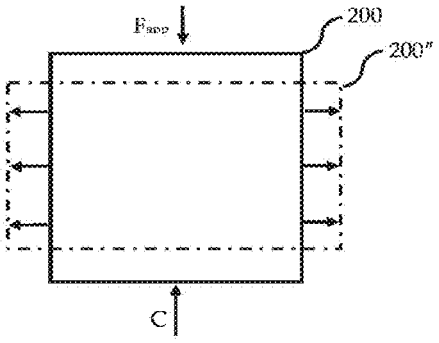

FIG. 2B depicts the same square fabric 200 having a positive Poisson's ratio, in a compression context. Specifically, as force applied $F_{app}$ is reversed compared to the force depicted in FIG. 2A, compression C occurs and the fabric 200 expands horizontally while shrinking vertically (again with respect to the orientations depicted on the page).

Figure 2C:
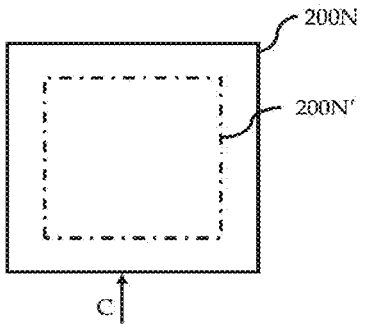
Figure 2D:
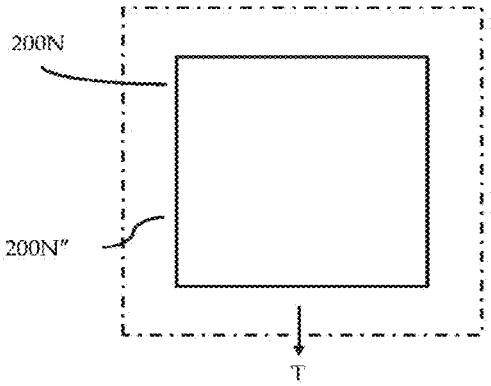

FIGS. 2C and 2D depict auxetic materials characterized by a negative Poisson's ratio. Fabric 200N has a negative Poisson's ratio, such that compression from any one direction causes contraction not only along that dimension, but also along the perpendicular direction. It should be understood that the drawings shown in FIGS. 2C and 2D are two-dimensional simplifications, and in alternative embodiments the contraction could be along another axis (or multiple axes). Upon application of compression C, as shown in FIG. 2C, fabric 200N changes to the dashed size 200N', contracting in both vertical and horizontal directions. Upon application of tension T, as shown in FIG. 2D, fabric 200N changes to the dashed size 200N", expanding in both vertical and horizontal directions.

FIGS. 2E and 2F depict a fabric 200AN having an active negative Poisson's ratio. That is, upon application of external stimulus S, as shown in FIG. 2E, fabric 200AN contracts in both directions, horizontal and vertical, to the shape shown in dashed lines as 200AN', even in the presence of some tensile force T. Contrariwise, upon application of external stimulus S to fabric 200AN, the fabric expands, even in the presence of some compressive force C.

Depending upon the application, the phenomena shown in FIG. 2A-2B, 2C-2D, or 2E-2F can be selected by a designer to create novel and useful fabrics and garments. For example, it may be desirable to provide a fabric that has a nominal length that can be expanded by applying appropriate tension or compression in a transverse direction, as shown in FIGS. 2A-2B.

In other implementations, such as impact-resistant fabrics where densifying upon application of compressive force is desirable, fabric 200N of FIGS. 2C and 2D may be more appropriate. Examples of such fabrics include sporting equipment (e.g., helmets, skiwear, knee or elbow portions of athletic wear, etc.) that is flexible during normal use but densifies upon impact, police garments, fall protection, or other similar protective gear, or garments used in environments where the ambient conditions are hazardous such as space-suits used during extravehicular activity that are subject to micrometeorite strikes at high velocity.

In other implementations, such as those in which transverse impacts are likely, the fabric 200AN of FIGS. 2E and 2F can be more appropriate. For example, a motorcyclist's attire could benefit from pads of material that densifies upon application of shear tension T caused by sliding cross a roadway.

Figure 2G:
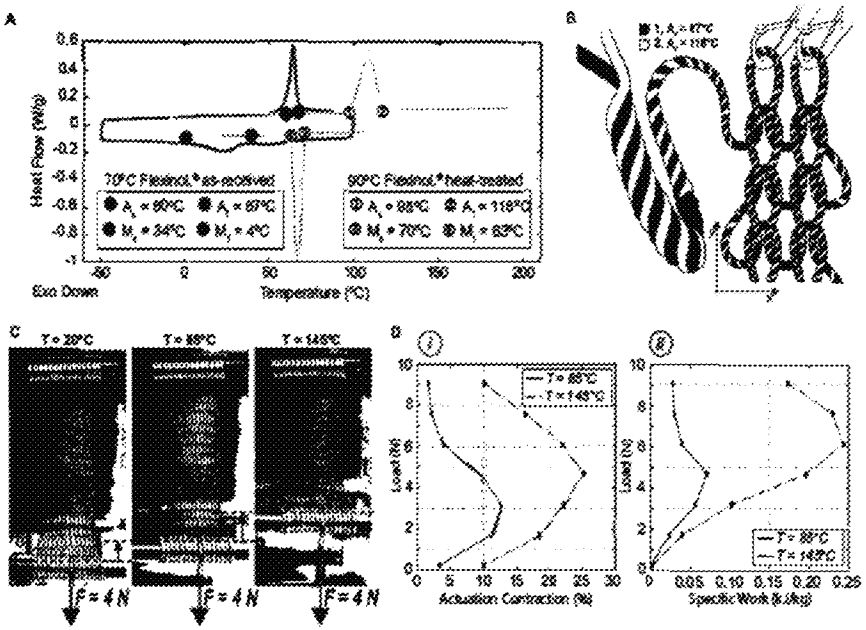
FIG. 2G shows a material undergoing variable recruitment in one embodiment.

In embodiments, these contraction or expansion characteristics do not need to be uniform across a textile. Rather, materials can exhibit variable recruitment as defined above. FIG. 2G depicts one mechanism for creating a structure exhibiting variable recruitment. Variable recruitment is enabled by multiple active filaments. As shown in pane (A), differential scanning calorimetry results for two SMA filaments depicts non-overlapping actuation thresholds ($A_s \rightarrow A_f$). As shown in pane (B), SMA filaments with different material compositions are combined to form a 1D variable recruitment yarn, which is reconfigured into a 2D active textile with variable recruitment behavior. As shown in pane (C), the active textile contracts partially at 85° C. and further contract at 145° C. as the second filament is recruited. As shown in pane (D), actuation contraction and specific work can be tuned across a range of applied stimuli—here, temperature change.

These third-order effects can be created, as alluded to above, by the appropriate selection of materials to create first-order shape memory effects, and by the appropriate pairing of such materials into yarns or clusters to create second-order effects, and finally by the overall knit pattern selected using those yarns, fibers, or combinations thereof.

Figures 3A, 3B, 3C, 3D, 3E, 3F:
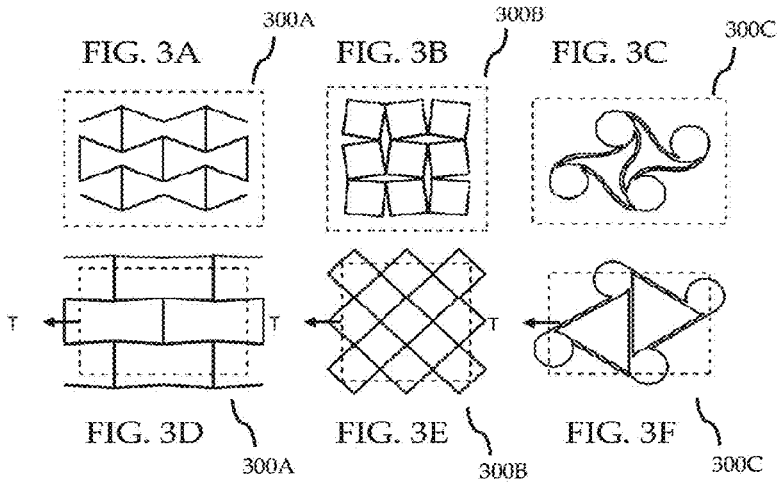
FIGS. 3A-3F show a series of more complex patterns that can be created by the selective use of textile geometries, according to three embodiments.

FIGS. 3A-3F show a series of more complex patterns that can be created by the selective use of fibers, yarns, or perforated laminates, according to six embodiments. FIGS. 3A-3C depict auxetic structures 300A, 300B, and 300C under no external forces, respectively. FIGS. 3D-3F depict the same structures 300A, 300B, and 300C under axial tension, respectively.

Auxetic behavior can be enabled by auxetic materials (e.g., auxetic polymeric fibers) integrated into non-auxetic structures or by non-auxetic materials configured into auxetic structures that enable internal restructuring. Common auxetic structures include re-entrant, rotating polygon, chiral, crumpled sheet, and perforated sheet models, such as those depicted in FIGS. 3A-3F. Traditional textile structures have utilized auxetic models to induce auxetic textile behavior, specifically weft and warp knitted fabrics. Alternatively, auxetic warp knit structures have utilized manufacturing guide bars to inlay limiting yarns into open chain or pillar stitches. Few auxetic structures, however, whether textile or non-textile, have been made from or incorporated active materials. As disclosed herein, the use of active materials in textiles presents new ways of leveraging bending and torsion inherent to traditional textiles structures to design actuating auxetic textile structures with active material filaments. Likewise, novel applications of shape memory materials result in unique forms of anisotropy or shear in the design and performance of active textiles. In addition to smart wearable garments, the creation of active auxetic, anisotropic, and shearing textiles enables advancements for soft robots, reconfigurable aerospace structures, and medical devices.

Such applications can incorporate the knitting patterns previously described with respect to FIGS. 1A-1P. For example, when each fiber of the fabrics 100A, 100D, 100G, 100J, and 100M is made of a shape memory alloy wire, transformations can be induced in response to temperature, two material behaviors—the shape memory effect (SME) and superelasticity (SE)—are observable. The SME, or the ability to recover large mechanical deformations, is demonstrated when SMA is deformed in a lower-temperature, less stiff martensite state and recovers that deformation through a thermally-induced transition to a higher-temperature, higher-force austenite state. SE behavior enables SMA to maintain constant forces/stresses over large plateau strains, making the material an excellent mechanical damper.

The characteristics of the fabrics made in this way showed that these knitting patterns, when combined with smart materials, produce complex actuation behaviors. Prior work on SMA knitted actuators has explored axial contraction, curling, or corrugation, as described in application 62/831,276, the contents of which are hereby incorporated by reference in their entirety. Each of the five textiles depicted in FIGS. 1A-1P exhibited shape memory recovery of mechanical deformations imposed in the manufacturing process to produced novel actuation behaviors, such as biaxial contraction ($v=-0.3$ to $-1.5$) and shear ($\Delta\theta=7°$). Force-displacement testing suggests that these active structures have the potential to be powerful actuators with unique, anisotropic behaviors that could be tailored for a given application. Such novel, reconfigurable structures contribute to a new actuation paradigm that impacts innumerable applications, touching wearables, medical devices, soft robotics, or aerospace structures.

Second-Order Effects Using Yarns

The use of filaments and fibers results in unique fabrics, as described above. The structures described above, however, do not necessarily benefit the second-order effects that are possible to achieve through use of yarns. As described above, yarns are (broadly speaking) bundles of individual fibers or filaments. The choice of which fibers, how many fibers, and how the fibers are twisted together (or otherwise arranged together) determines the type and amount of second-order effect.

Figure 4A:
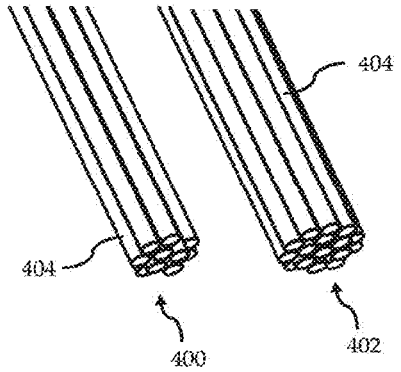
FIGS. 4A-4D show untwisted yarns including a variety of materials, filament sizes, and plies, according to various embodiments.

FIG. 4A shows two simple yarns. As shown in FIG. 4A, two yarns 400 and 402 are arranged side-by-side. Yarn 402 contains ten fibers 404 (i.e., yarn 400 is 10-ply), whereas yarn 402 contains fifteen fibers (i.e., yarn 402 is 15-ply). The materials within each fiber are identical to one another, and the yarn is a very simple construction, with no twists, tension, or even necessarily interaction between the plies.

Figure 4B:
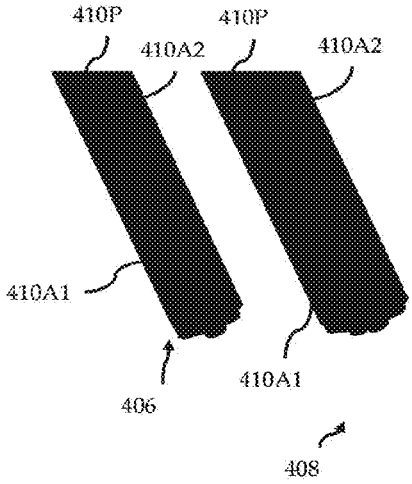

FIG. 4B depicts more complex yarns 406 and 408. Like their counterparts 400 and 402 in FIG. 4A, yarns 406 and 408 of FIG. 4B are made up of ten and fifteen fibers, respectively. Unlike their counterparts in FIG. 4A, however, the composition of the individual fibers varies.

As shown in FIG. 4B, yarn 406 is made up of three different types of fiber: passive fibers (410P), first active material fibers (410A1), and second active material fibers (410A2). These fibers are differentiated in FIG. 4B by their shading, but it should be understood that the differences between the fibers may not always be visually discernible. Nonetheless, the different fibers (410P, 410A1, and 410A2) are functionally different from one another. Depending upon the material used to form each of the fibers (410P, 410A1, and 410A2) and how those fibers are "trained" for shape memory effect, the activation of the active properties of the active fibers 410A1 and 410A2 can create desired second-order effects in the overall yarn (406, 408).

Figure 4C:
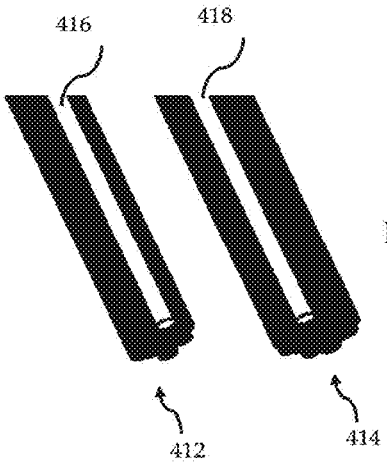

FIG. 4C shows one possible selection of active and inactive fibers. As shown in FIG. 4C, a yarn single passive fiber is arranged within a bundle of active fibers. Like FIGS. 4A and 4B, FIG. 4C shows two yarns (412, 414) are arranged side by side. The two yarns (412, 414) are distinguished by a first characteristic, the number of plies. Specifically, yarn 412 includes ten plies while yarn 414 includes fifteen plies. Of these plies, yarns 412 and 414 each contain one active fiber (416 and 416, respectively). The remainder of the plies, as shown with different shading, are formed of a different, passive material.

Upon actuation, the active fibers 416 and 416 cause deformation of the overall yarns 412 and 414. However, due the relatively greater number of passive plies in yarn 414, deformation may be different even though the two active fibers 416 and 418 are otherwise functionally equivalent.

Figure 4D:
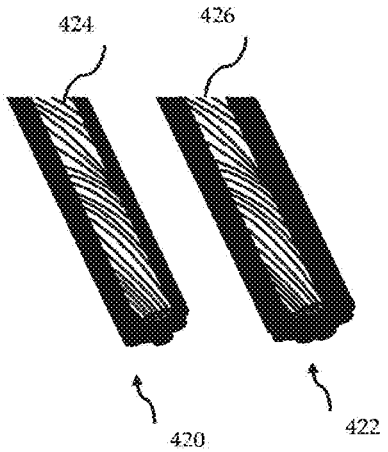

FIG. 4D illustrates another design choice that can be implemented in the creation of a yarn for a specific second-order effect. Specifically, in addition to the choice of materials, the arrangement of those materials within the yarn, and the number of plies, the thickness of each ply can be controlled. FIG. 4D shows two yarns, 420 and 422, again varying from one another in the number of plies. The size of each individual one of the plies in each of the yarns (420, 422) can be varied. As shown in yarn 420, ply 424 is substantially larger than the remainder of the plies (and is also a different material). Likewise, in yarn 422, ply 426 is substantially larger than the remainder of the plies (and is also a different material).

In some circumstances, a larger or smaller cross-section of an active material may be desirable, in order to modify the density of a fabric or garment incorporating the yarn (e.g., 420, 422). Likewise, the cross-section of a passive material may be modified to adjust the overall second-order effects exhibited by the yarn.

Figure 5A:
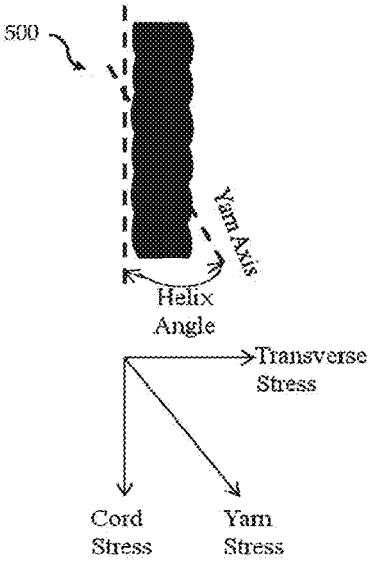
FIGS. 5A and 5B show twisted yarns with different levels of twists per inch, according to two embodiments.
Figure 5B:
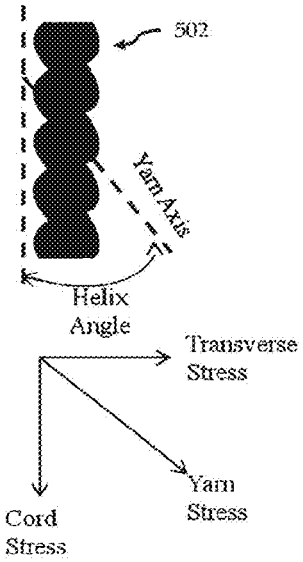

FIGS. 5A and 5B depict another variable that can be controlled in designing a yarn for a particular second-order effect: twisting. Spun yarns can be designed with a set number of twists per inch. FIG. 5A shows a yarn 500 with a relatively higher number of twists per inch, whereas FIG. 5B shows a yarn 502 with a relatively lower number of twists per inch. The number of twists per inch can also be described in terms of the helix angle during the yarn formation process, shown in dashed lines. To set a desired number of twists per inch, the yarn axis can be set by modifying the ratio of transverse stress to cord stress (i.e., the yarn stress vector angle) as the yarn is being formed. During manufacture, level of twist is accomplished through a ratio of rotational speed N and yarn delivery speed V. The yarn stress, including both transverse and cord components, is typically a level of stress present in the un-activated, martensite state of the fibers, and remains in the yarn as an inactive force. In some circumstances, however, the yarn can also be formed with the fibers in the activated, austenite state (such as by twisting the fibers at a high temperature).

In alternative embodiments, spinning the material in the martensite state can be used to detwin the material. As long as spinning stresses are below a threshold, detwinning the material during spinning can give the yarns formed by this process more actuation potential. Above that threshold, the materials could experience some plasticity.

Spinning the material above the austenite finish temperature could still result in yarn detwinning if the tensile force from spinning is large enough to stress the material into a martensite state. Otherwise, the material is spun in an austenite state and needs higher applied loads post-spinning to detwin and observe actuation.

Spinning in the austenite state can produce unique spun yarn architecture when used with SMA materials with different transition temperatures. Material state during spinning can be used to generate different actuation performance. It may be beneficial to change the ambient temperature during the spinning process to ensure a material is in a specific material state during spinning. For example, spinning variable recruitment yarns in room temp with different transition temperatures (2 yarns austenite and 1 yarn martensite at spin) produces incompatible yarns that have elements that buckle outward upon actuation. If such individual filament buckling is not desirable, then heating the room above the highest austenite finish temperature or cooling the room below the lowest martensite finish temperature will ensure that all filaments are spun either in an austenite or martensite state, respectively. This improves yarn compatibility, or specifically mitigates individual filament buckling, for embodiments in which such phenomena are not desired. In other embodiments, individual filament buckling may be desirable either alone or in combination with knit loop buckling, and conditions can be set during spinning accordingly.

Active and Inactive Forces in Yarns to Create Second-Order Effects

Figure 5C:
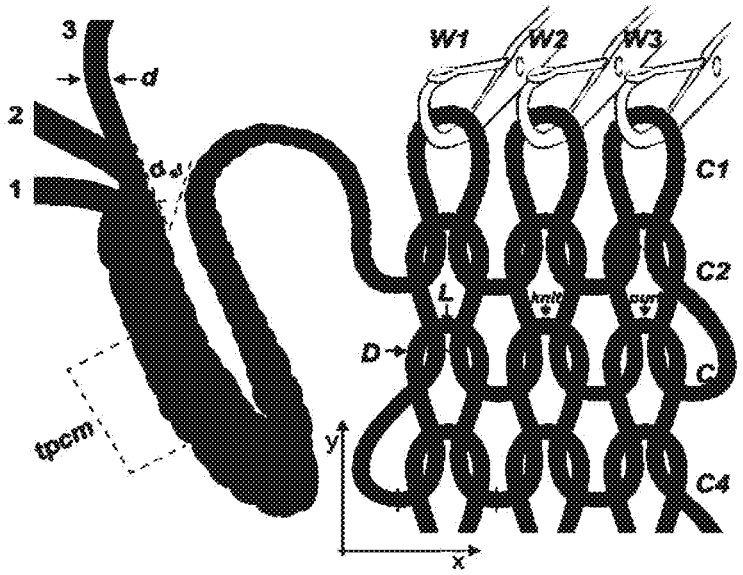
FIG. 5C shows a yarn that exhibits a second-order effect according to an embodiment.

A mechanics-based investigation of active textiles composed of torque-unbalanced active yarns (here, called torque-unbalanced active textiles) starts with an understanding of the design variables that tune the properties of torque-unbalanced active filaments and yarns. In solid mechanics, a filament in torsion experiences shear strains and stresses that start at the outer surface of the filament and migrate towards filament center upon an increase in the torsional moment. Because SMA material phases (i.e., austenite, martensite) are stress and temperature dependent (see FIG. 3 of WO 2019/108794 A1), shear stresses and strains produced by yarn spinning influence the stress distribution and, consequently, phase transformation capabilities of active filaments and yarns. FIG. 5C shows a yarn made up of three fibers (1, 2, and 3) having a set number of twists per centimeter (tpcm) and with a given surface filament helical bias angle ($\alpha$sf). The yarn is used within a 2D textile structure, such as a weft knit, with a certain loop length (L). 2D textile structures are scaled by modifying the number of knitted wales (W1-3) and knitted courses (C1-4).

Prior work has shown that rotational deformations can inhibit martensite-austenite phase transformation, starting at the outer filament radius and migrating towards center with increased twist. The stress state at which martensite-austenite phase transformation is impaired occurs when equivalent stress ($\sigma_{eq}$) at the outermost radius is equal to or surpasses a critical stress ($\sigma_e$):

$$\sigma_{eq} \geq \sigma_e$$

defined by the temperature applied to the active filament (T), the material-specific martensite start temperature ($M_s$), and the slope of the stress-dependent austenite finish temperature ($C_A$).

$$\sigma_{eq} = C_A(T - M_s)$$

Taking one material, 90° C. FLEXINOL®, as an example, the martensite start temperature ($M_s$=42° C., FIG. 1B) and the slope of the stress-dependent austenite finish temperature ($C_A$=8.5 MPa/° C.) can be determined experimentally. If the maximum applied temperature (T) is 120° C., we can assume that any SMA filament that experiences equivalent stress of 663 MPa or greater through manufactured torsion will not experience an austenitic phase transformation at the outermost radius of the filament and, consequently, will exhibit reduced actuation performance.

Figure 5D:
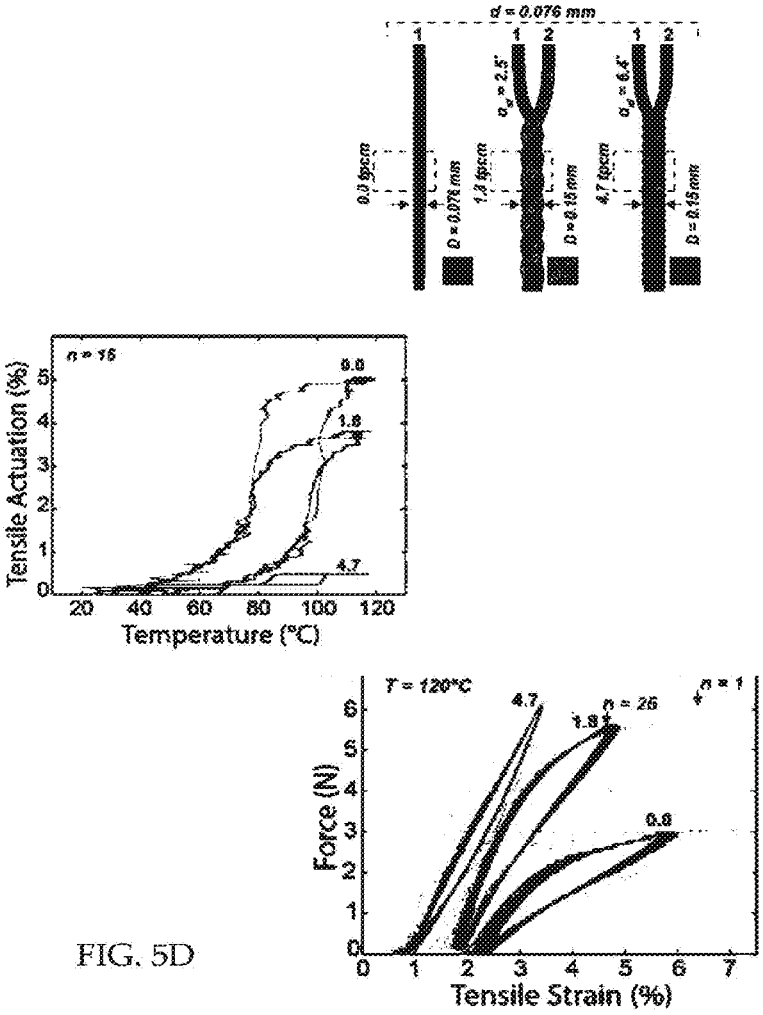
FIG. 5D shows multiple yarn constructions with varying inputs to achieve different functionalities.

To evaluate the effect of twist on the mechanical properties of active filaments, a single active filament (i.e., 90° C. FLEXINOL®, d=0.076 mm, made by Dynalloy, Inc.) was compared to two torque-unbalanced active yarns with varying amounts of twist (t=[1.8, 4.7] tpcm) as shown in FIG. 5D. One yarn was twisted above the critical stress threshold ($\sigma_e > \sigma_{eq,4.7}$=680 MPa) and the other remained below the critical stress($\sigma_e > \sigma_{eq,1.8}$=658 MPa) threshold. Outer surface filament shear ($\gamma$) in radians can be calculated using known angle of twist ($\theta$) produced during yarn spinning, the filament radius (r), and the length of filament (l). Shear strain ($\gamma$) for one full torsional rotation ($\theta$=3600=2$\pi$) and the length of yarn per rotation (l) can be determined through the applied yarn twist (t) per unit length (l=1/t):

$$\gamma = \frac{\theta r}{l} = \frac{2\pi r}{l} \tag{1}$$

Assuming linear elasticity, equivalent strains ($\Sigma_{eq}$) can be determined from the shear stress ($\gamma$) produced during yarn spinning.

$$\varepsilon_{eq} = |\gamma|/\sqrt{3} \tag{2}$$

Tensile actuation data in FIG. 5D was gathered by thermally cycling a SMA filament (90° C. Flexinol®) 15 times (n=15) under an applied load of 0.8 N, which is the maximum safe stress for an active filament with a diameter of 0.076 mm. Both active yarns (t=[1.8 tpcm, 4.7 tpcm]) were composed of two SMA filaments and, therefore, were evaluated under twice the applied load ($F_{app}$=1.6 N). All samples were exposed to repeated thermal cycles between 20° C. (below the material-specific inactive, or martensite, temperature) and 120° C. (above the material-specific active, or austenite, temperature). Heating and cooling rates were set to 6.7° C./min. The active material state temperature was held for 10-minutes and the inactive state temperature was held for 5-minutes, resulting in 45-minute thermal cycles. Here, tensile actuation is defined by the initial inactive length ($l_i$) under the chosen applied load (F) and any new length ($l_n$) in response to temperature changes.

$$\text{Tensile actuation [\%]} = \frac{l_i - l_n}{l_i} \times 100 \tag{3}$$

The single active filament in FIG. 5D accomplished tensile actuation up to 5% under an applied load of 0.8 N (Equation 3), produced by martensite-austenite material phase transformation. The low-twist active yarn (t=1.8 tpcm) accomplished reduced tensile actuation (3.7%) under twice the applied load (F=1.6 N) and tensile actuation of the high-twist yarn was further reduced (0.5%).

Tensile strain data in FIG. 2A was gathered through a pull-out testing procedure. The procedure was conducted with active yarns depicted in FIG. 5D as well as single SMA filaments with diameters of 0.076 mm and 0.127 mm. To compare the behavior between both active yarns, the highly twisted yarn was evaluated up to the same maximum load as was used for the lightly twisted yarn ($F_{max}$=6.2 N). The yarn were subsequently unloaded at a rate of 0.05 mm/s. The same procedure was conducted for both SMA filaments (d=0.076 mm, 0.127 mm) at a temperature of 20° C. to observe the stress-strain behavior of that material in a martensitic state. Tensile strain (FIG. 5D, bottom pane) is defined by the austenite free length ($l_{af}$) and any new stretched length ($l_n$).

$$\text{Tensile strain [\%]} = \frac{l_n - l_{af}}{l_{af}} \times 100 \tag{4}$$

The single active filament and both active yarns depicted in FIG. 5D were mechanically loaded and unloaded fifteen to twenty-five times to observe cycle stability.

Increasing yarn twist also reduced hysteresis and tensile strain (Equation 4) when loaded and unloaded in an active material state [T=120° C.] (FIG. 5D). While the single active filament and the 1D active yarn with less twist in FIG. 5D accomplished greater tensile strain, the yarn with increased twist exhibited highly repeatable and nearly linear loading and unloading in an active material state at over 2.3% actuator strain. To verify that the high-twist yarn had surpassed the critical stress threshold and was dominated by a detwinned martensite material state, yarn stiffness at 120° C. was compared to filament stiffness at 120° C. when mechanically loaded and unloaded within a high-stress detwinned martensite regime (1315 MPa≤$\sigma$≥658 MPa). The single active filament exhibited approximately twice the stiffness of the high-twist 2-filament yarn (4.3 N/%, 1 filament, 0.0 tpcm; 2.6 N/%, 2 filament, 4.7 tpcm) depicted in FIG. 5D, indicating that stress-induced martensite is the dominate material state in active yarns whose manufacturing stresses surpass 663 MPa.

Although yarn geometries reduce (rather than enhance) axial actuation behavior of active filaments, knit textile geometries are known to enhance the structural strain and actuation behavior of active filaments and yarns. Additionally, enlarging knitted loops can further increase the actuation capabilities of an active textiles by increasing the mass of active material enclosed in the knitted loop and decreasing the loop bending radii to minimize material stresses. To demonstrate the impact of textile geometry on axial actuation performance, the behavior of a torque-unbalanced active yarn was compared to two active textiles with varying loop lengths (L) composed of the same active yarn.

Figures 2, 5E:
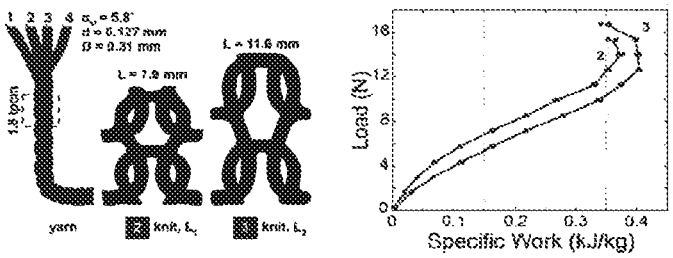

FIGS. 5E-1 and 5E-2 show a system in which four active filaments (90° C. FLEXINOL®), each with a diameter (d) of 0.127 mm, were spun to produce a single 1D active yarn with 1.8 tpcm and a surface filament axis helical bias angle ($\alpha_{sf}$) of 5.8°. The 1D active yarn produced work below 0.05 J and maximum linear actuation contraction of 5%. When the same active yarn was reconfigured into a textile geometry with an average loop length of 7.9 mm, actuation contraction capabilities surpassed 20% and work more than doubled. Actuation contraction and mechanical work were further increased by increasing the average loop length to 11.6 mm. While amplified actuation contraction and work are desirable for many actuator applications—notably wearables—the tradeoff for increased strain capability is reduced actuator stiffness. Maximum specific work for active textile 2 and 3 were 0.37 kJ/kg and 0.41 kJ/kg, respectively, as shown in FIG. 5F. The results demonstrate that textile geometries do more than aggregate 1D active yarns—textile geometries amplify and tune the mechanical performance of 1D active yarns across a 2D plane.

The use of the number of filaments, the materials within active filaments, the width of each filament, and the number of twist per inch in a yarn construction can all be used to modify the second-order effects as described in the previous sections. The charts in FIGS. 6A-13C further depict the effect that these second-order.

FIGS. 6A to 13C show the magnitude of these second-order effects based upon the manipulation of these characteristics of fibers or filaments within a yarn.

Figure 6A:
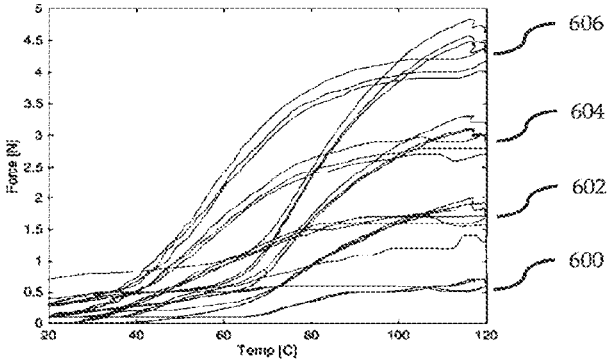
FIGS. 6A and 6B show force as a function of temperature for textiles composed of spun yarn and shape-memory monofilament, respectively, according to two embodiments.
Figure 6B:
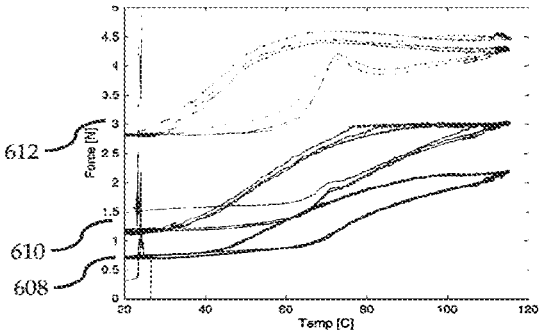

FIGS. 6A and 6B correspond to spun shape-memory alloy yarn and shape-memory filament in a knitted configuration, respectively. As depicted by the differences between these figures, the use of spun yarn results in decreased inactive force and increased active force, compared to a monofilament.

FIG. 6A shows force as a function of temperature for a knit textile composed of spun shape-memory alloy (SMA) yarns that are made up of a bundle of three SMA wires each having a 0.0762 mm diameter, spun with nine twists per inch. The combined cross-sectional area of the three SMA wires is therefore 0.0368 $m^2$. Plots 600 were created at 15% structural strain, plots 602 were created at 30% structural strain, plots 604 were created at 45% structural strain, and plots 606 were created at 60% structural strain in relation to an austenite free length (i.e. austenite material state under no applied loads). As shown in FIG. 6A, the use of yarns with higher structural strain built in results in a much higher change in force (ΔF) between the martensite state (at low temperature) and the austenite state (at high temperature).

FIG. 6B shows that, with a SMA filament having a 0.127 mm diameter (i.e., an active cross-sectional area of 0.01267 $mm^2$). The SMA filament in FIG. 6B is therefore approximately equivalent, in terms of cross-sectional SMA material, to the yarn of FIG. 6A. Plot 608 is created at 15% structural strain, plot 610 is created at a 30% structural strain, and plot 610 is created at a 45% structural strain in relation to a martensite free length (i.e. martensite material state under no applied loads) (higher levels are not possible for single-filament SMA fibers). The highest level of ΔF created by any of the single-filament constructions, regardless of structural strain, is about 1.5-2 N. In contrast, yarns at 9 twists per inch as shown in FIG. 6A can generate ΔF of up to 4-5 N. In other words, SMA knitted actuators made with spun SMA yarns reach larger generated force values compared to their monofilament equivalents when actuated.

Figure 7A:
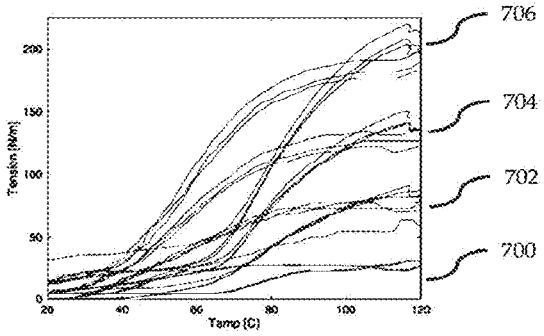
FIGS. 7A and 7B show unit tension (i.e., force per unit width) as a function for the spun yarn and monofilaments of FIGS. 6A and 6B textiles, respectively.
Figure 7B:
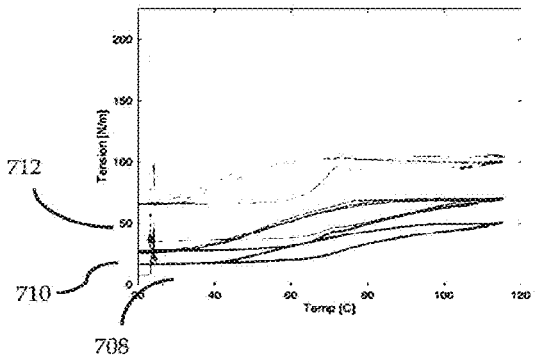

Furthermore, SMA knitted actuators made with SMA yarns produce higher force per unit width (N/m) than their monofilament equivalents. FIGS. 7A and 7B show unit tension as a function of temperature for the same yarns and filaments described with respect to FIGS. 6A and 6B, respectively. Plot 708 is created at 15% structural strain, plot 710 is created at a 30% structural strain, and plot 710 is created at a 45% structural strain (higher levels are not possible for single-filament SMA fibers). The highest level of tension created by any of the single-filament constructions, regardless of structural strain, is about 100 N/m. In contrast, yarns at 9 twists per inch as shown in FIG. 7A can generate unit tension of up to 200 N/m. In other words, SMA knitted actuators made with spun SMA yarns reach larger generated unit tension values compared to their monofilament equivalents.

Figure 8A:
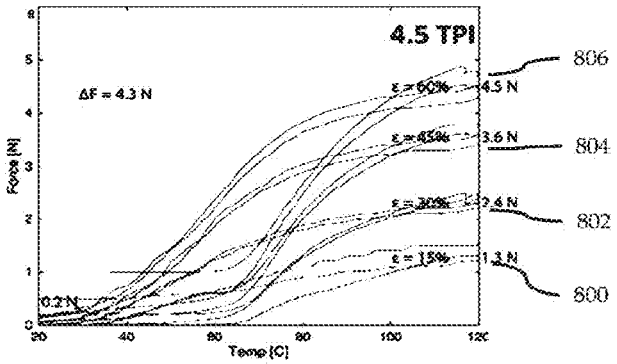
FIGS. 8A-8C show force as a function of temperature for textiles composed of spun yarns of shape memory material according to embodiments with 4.5, 9, and 12 twists per inch, respectively.
Figure 8B:
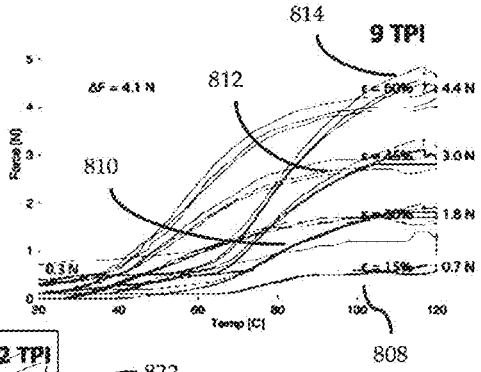
Figure 8C:
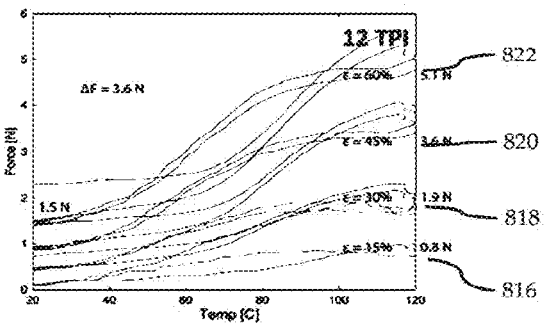

FIGS. 8A-8C show the effect of increasing twists per inch on the force generated by knitted textiles made with spun SMA yarns. Each of the filaments for which data is shown in FIGS. 8A-8C are 3 mil wire.

FIG. 8A shows force generated by spun fibers that are combined at 4.5 twists per inch when knit into a fabric structure. Similar to the data shown in FIGS. 6A-7B, FIG. 8A shows data for various levels of structural strain. Specifically, FIG. 8A shows force as a function of temperature for spun SMA yarns at 15% structural strain (plot 800), 30% structural strain (plot 802), 45% structural strain (plot 804), and 60% structural strain (plot 806). As shown in FIG. 8A, the use of yarns with higher structural strain built in results in ΔF between the martensite state (at low temperature) and the austenite state (at high temperature). Depending upon the level of structural strain built in, ΔF ranges between about 1N and about 4.3N.

FIG. 8B similarly shows force as a function of temperature for spun fibers. FIG. 8B is similar to FIG. 8A in most respects, except that the yarns that generated the force profiles shown in FIG. 8B are wound at 9 twists per inch instead of 4.5 twists per inch. FIG. 8B shows force as a function of temperature for spun SMA yarns at 15% structural strain (plot 808), 30% structural strain (plot 810), 45% structural strain (plot 812), and 60% structural strain (plot 814).

Comparing FIG. 8A with FIG. 8B, it is apparent that the higher number of twists per inch affects the total ΔF, the absolute level of force (F), and the shape of the curve between martensite and austenite conditions. Specifically, the martensite force is somewhat higher for the higher number of twists per inch (from about 0.2N to about 0.3N). The total force applied in the austenite state is slightly higher in FIG. 8A, depending on the fiber (from about 4.4N to about 4.3N).

FIG. 8C shows the same constructions of fibers, except that the fibers are twisted more tightly, at 12 twists per inch. FIG. 8C shows force as a function of temperature for spun SMA yarns at 15% structural strain (plot 816), 30% structural strain (plot 818), 45% structural strain (plot 820), and 60% structural strain (plot 822). Again comparing to the counterpart plots in FIGS. 8A and 8B, the martensite force is somewhat higher for the higher number of twists per inch (as high as about 2.2 N of inactive force in some embodiments). The total force applied in the austenite state is much higher in FIG. 8C, reaching as high as 5-6N in FIG. 8C.

In some applications, increased total actuation force ΔF or, on the other hand, increased ΔF for purposes of absorbing force, will be desirable. In other applications, the total force F will be of primary importance, such as applications in which a level of medical compression is desired and applying too much force would be undesirable.

Figure 9A:
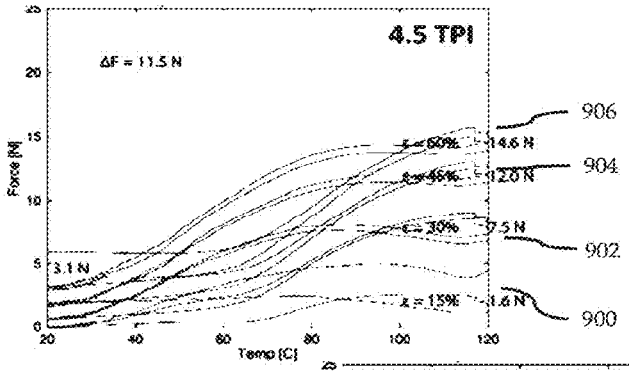
FIGS. 9A-9C show force as a function of temperature for textiles composed of spun yarns of shape memory material according to embodiments with 4.5, 9, and 12 twists per inch, respectively, and in which the diameter of each filament is increased as compared to FIGS. 8A-8C.
Figure 9B:
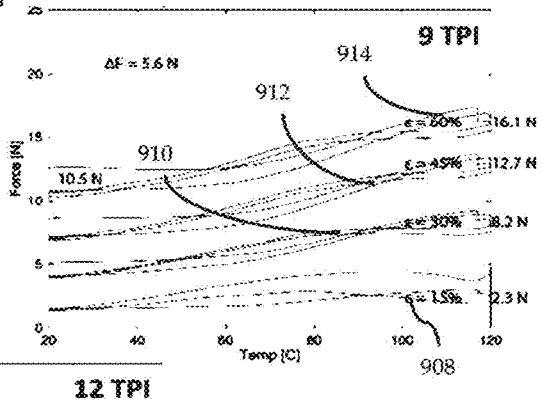
Figure 9C:
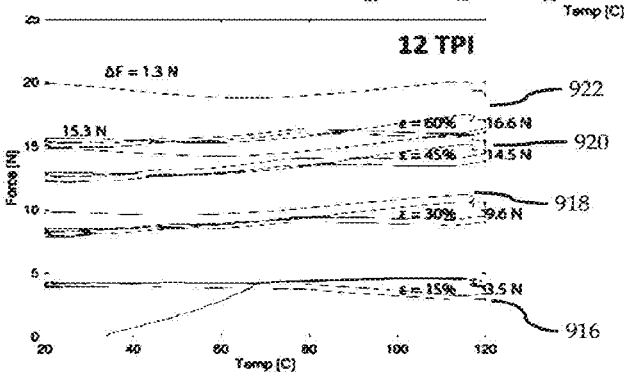

These trends can be replicated for other filaments. FIGS. 9A-9C are substantially the same as the charts depicted in FIGS. 8A-8C, except that the filaments are each 5 mil wire, rather than 3 mil wire. Like plots are labeled with like reference numbers, iterated by 100, relative to their counterparts in FIGS. 8A-8C.

FIG. 9A shows the force output by knit textiles composed of yarns created at 4.5 twists per inch; FIG. 9B shows the force output by yarns created at 9 twists per inch, and FIG. 9C shows force output by yarns created at 12 twists per inch. Use of thicker, 5 mil filaments causes increase in inactive forces, such that ΔF is relatively low in FIG. 9C, no matter which structural strain level is selected (referred to as "saturation"). However, as shown by the difference in total force F between plots 916, 918, 920, and 922, the structural strain (15, 30, 45, and 60%, respectively) can be used to set a desired level of force output even for saturated yarns.

FIGS. 8A-8C show the effect of twists per inch, and the comparison of FIGS. 8A-8C with 9A-9C show the effect of increasing the diameter of each ply in a yarn. Additionally, the number of plies in a yarn can be used to change the characteristics of the yarn. FIGS. 10A, 10B, and 10C show force output as a function of temperature for 2-ply, 3-ply, and 4-ply yarns. Each of the filaments are 3 mil, similar to the filaments that corresponded to the plots shown in FIGS.

8A-8C. Like plots are labeled with like reference numbers, iterated by factors of 100, relative to their counterparts in FIGS. 8A-8C and FIGS. 9A-9C.

FIGS. 10A-10C show that ΔF is 3.7N or less for 2-ply yarns, 4.1N for 3-ply yarns, and 5.3N for 4-ply yarns having the characteristics described above. In other words, ΔF can be tailored by selecting the number of plies of active materials.

FIGS. 11A-11C show the same force plots described above with respect to FIGS. 10A-10C, respectively, except that the plots 1100-1122 of FIGS. 11A-11C correspond to 5 mil filaments. As shown in FIG. 11A and, to some extent, FIG. 11B, increasing the diameter of the filaments causes a corresponding increase in ΔF. However, high numbers of plies in combination with higher diameter of each filament can cause saturation, as shown by the flattening of the slope of plots 1108-1122 in FIGS. 11B and 11C.

Figure 12A:
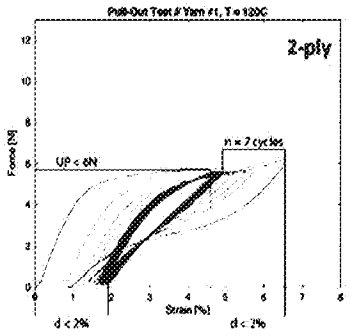
FIGS. 12A-12C show force as a function of strain for individual spun yarns, according to embodiments in which the overall yarn includes 2 plies, 3 plies, or 4 plies, respectively.
Figure 12B:
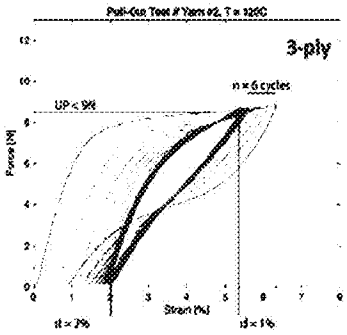
Figure 12C:
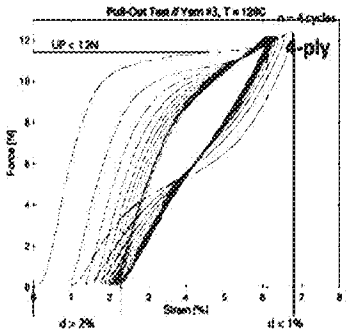

FIGS. 12A-12C show the effect that increasing the total number of plies in a yarn has on the force on the yarn (i.e., not knitted into a fabric). FIG. 12A shows a plot of force as a function of structural strain for a 2-ply yarn over 15 mechanical loading and unloading cycles, which stabilized performance after seven cycles. FIG. 12B shows a plot of force as a function of structural strain for a 3-ply yarn over 15 mechanical loading and unloading cycles, which stabilized performance after six cycles. FIG. 12C shows a plot of force as a function of strain for a 4-ply yarn over 15 mechanical loading and unloading cycles, which stabilized performance after four cycles. As shown in FIGS. 12A-12C, increasing yarn plies decreases the number of pull-out cycles required to stabilize yarn thermomechanical performance, in addition to increasing yarn strain capabilities.

Figures 13A, 13B, 13C:
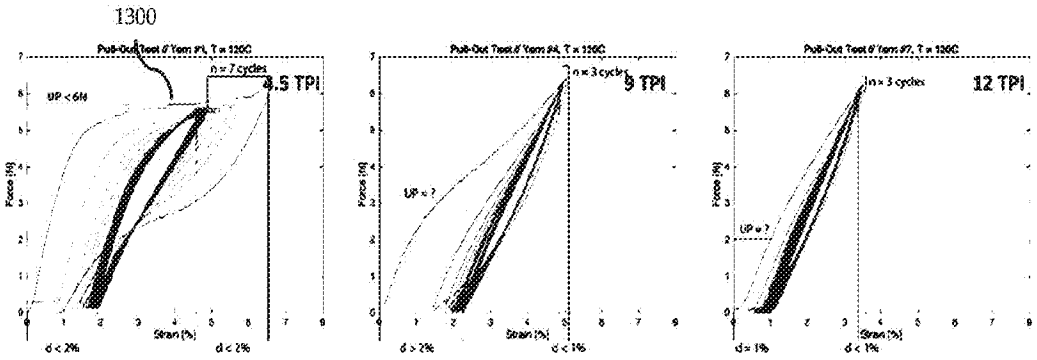
FIGS. 13A-13C show force as a function of strain for individual spun yarns, according to embodiments in which the number of twists per inch is 4.5, 9, and 12, respectively.

FIGS. 13A-13C show force as a function of strain for three yarns that differ only in the number of twists per inch. FIG. 13A corresponds to a yarn formed at 4.5 twists per inch; FIG. 13B corresponds to a yarn formed at 9 twists per inch; and FIG. 13C corresponds to a yarn formed at 12 twists per inch. As shown in FIGS. 13A-13C, increasing yarn twist decreases presence of the upper plateau 1300. Increasing yarn twist therefore reduces yarn strain capabilities. Furthermore, as shown by the tightening of the charts over multiple strain cycles shown in FIGS. 13A-13C, the yarn hysteresis decreases with increasing twists per inch. Thus for applications where consistent performance is important, higher twists per inch may be desirable. Furthermore, increasing yarn twists per inch reduces the number of pull-out cycles required to stabilize the yarn's thermomechanical performance.

Figures 14A, 14B, 14C:
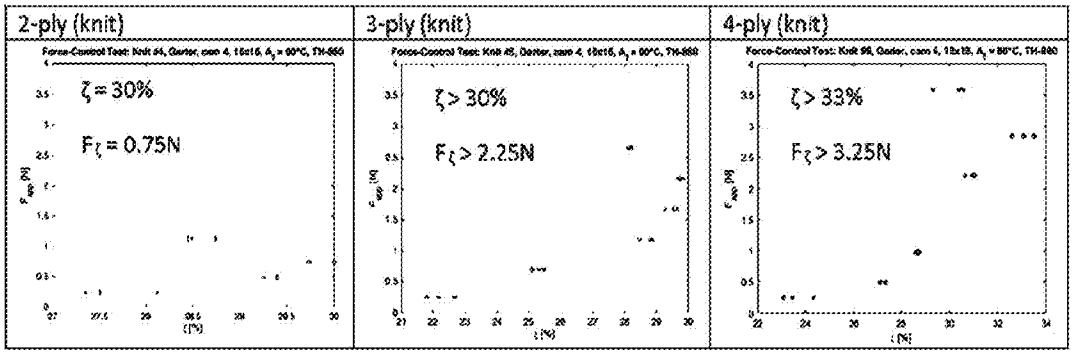
FIGS. 14A-14C show force as a function of actuation contraction for textiles composed of yarns in 2-ply, 3-ply, and 4-ply embodiments.

FIGS. 14A-14C show force as a function of actuation contraction (for textiles composed of 2-ply, 3-ply, and 4-ply yarns, respectively. Increasing the number of filaments in a spun SMA yarn knit into an SMA knitted actuator results in increased force requirements to reach maximum actuation contraction (0.75N, 2.25N, 3.25N; 2-ply, 3-ply, 4-ply, respectively, in FIGS. 14A, 14B, and 14C). Likewise, increasing the number of filaments increases actuation contraction (30%, 33%; 2-ply, 4-ply, respectively, in FIGS. 14A, 14B, and 14C).

Figures 15A, 15B:
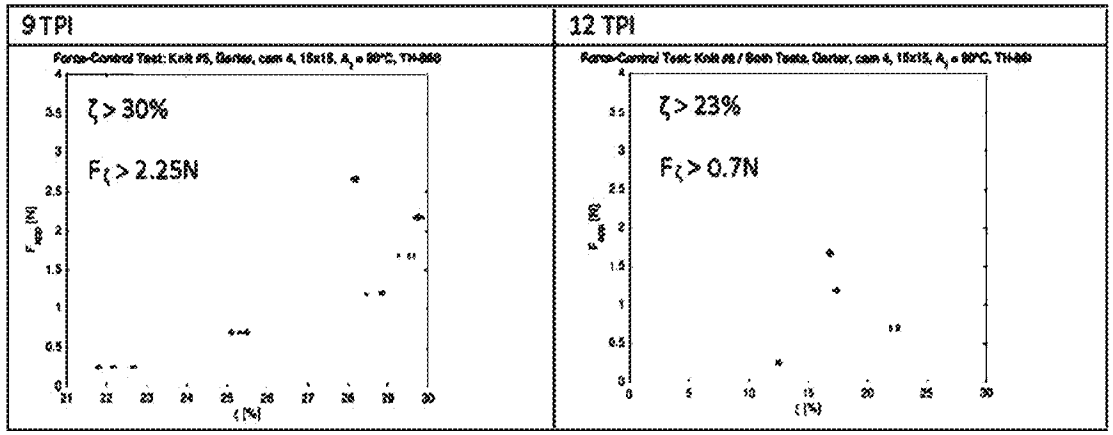
FIGS. 15A and 15B show force as a function of actuation contraction for textiles composed of yarns in embodiments with 9 twists per inch and 12 twists per inch, respectively.

FIGS. 15A and 15B show that increasing yarn twist (from 9 twists per inch to 12 twists per inch between FIGS. 15A and 15B, respectively) in a textile decreases maximum actuation contraction. Likewise, increasing yarn twist decreases the force at which maximum actuation contraction occurs from 2.25 N to 0.7 N between FIGS. 15A and 15B.

Figure 16:
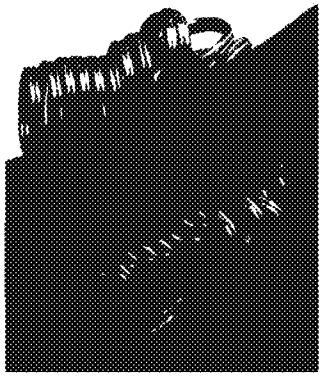
FIG. 16 depicts a knit material including both active and passive materials, according to an embodiment.

As shown in FIGS. 8A-15B, spun SMA yarns produce SMA knitted actuators that are narrower and more compact than monofilament SMA knitted actuators. Spun SMA yarns can easily introduce a passive fiber filament during the spinning process, imbuing a textile quality to the actuator fabric. Such a fabric is shown in FIG. 16, for example, in which wool and SMA materials are spun together into a yarn and knitted into a fabric.

Figure 17:
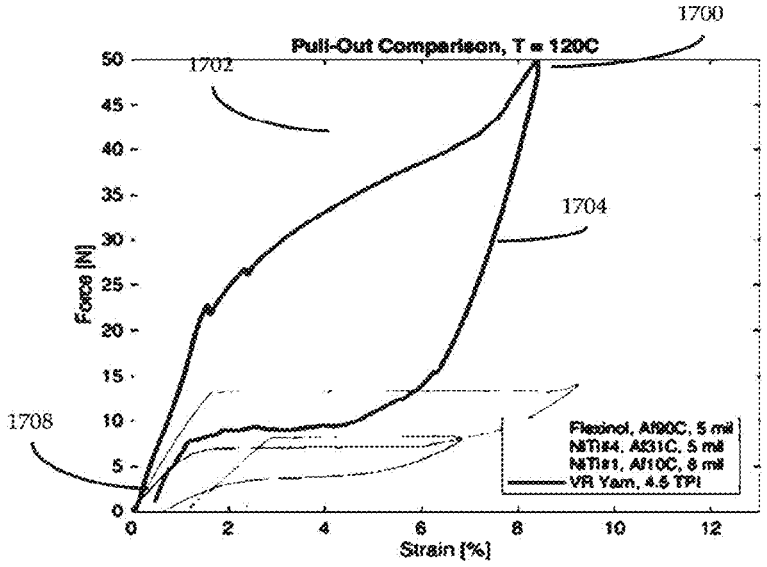
FIG. 17 depicts force as a function of strain for a yarn that incorporates multiple active shape memory materials, according to an embodiment.

One example of such a fabric is described with respect to FIG. 17. FIG. 17 shows the performance of a spun SMA yarn that includes SMA filaments with various actuation temperatures to create a yarn with composite behaviors. FIG. 17 depicts three straight wire pullout tests (1-3) at T=120 C along with a pullout test of all three wires spun together in a composite yarn. These three SMA wires include (1) one 90C Flexinol filament, 0.005" diameter; (2) one 31C NiTi #4 filament, 0.005" diameter, (3) one 10C NiTi #1 filament, 0.008" diameter. The composite behavior (purple) bundles all three wires together and spins them with 4.5 TPI. The plot in FIG. 17 depicts (at 1700) an upper plateau rounding from the spinning process, (at 1702) an upper plateau restiffening behaviors of the NiTi #1 around 43 N, (at 1704) an initial unloading stiffness attributed to NiTi #1, (at 1706) a lower plateau characterized by the upper plateau strength of Flexinol and lower plateau strength of NiTi #4, (at 1708) recovery less than 1% strain characterized by Flexinol recovery.

Buckling and Blocked Forces

Figure 18:
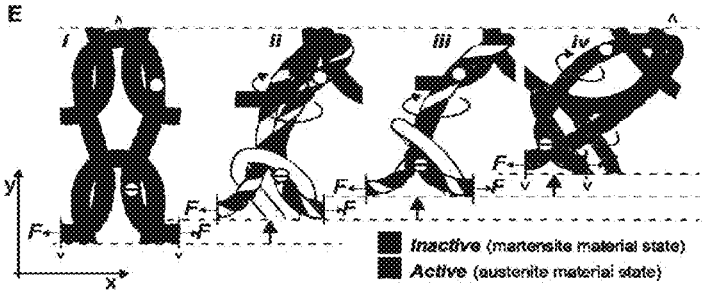
FIG. 18 shows the actuation motion (i-iv) of each knitted loop is produced through loop buckle.

Torque-unbalanced active yarns have not been previously investigated in textile geometries and are shown here to enhance the actuation performance of active textiles by altering the kinematic actuation motion of the knitted loop. As shown in FIG. 18, a torque-unbalanced knitted loop buckles at the loop apex and flips about the y-axis upon actuation. Compared to a torque-balanced active textile, this new kinematic motion can increase actuation performance of a torque unbalanced active textile in the y-axis and imbue the active textile with new actuation capabilities in the x-axis. Actuation performance of a torque-unbalanced active textile can be described by structural elastic-stability equations for bundles of twisted filaments. Buckling and snarl formation occurs in torque-unbalanced filaments when axial loading is insufficient to overcome the torsional filament moment.

FIG. 18 shows the actuation motion (i-iv) of each knitted loop is produced through loop buckle. Physics-based relationships can be used to identify the critical axial tension required to prevent filament buckling (Pf) and yarn buckling ($P_y$), a value that is scaled according to the number of filaments included in the yarn ($P_f \times n_f = P_y$). If we assume that each loop leg is a single active yarn, the critical axial tension to prevent textile buckling ($P_t$) can be determined by scaling the critical axial yarn tension ($P_y$) by twice the number of textile wales ($P_y \times 2W = P_t$). Therefore, the critical tensile force required to prevent yarn snarl formation in a textile (Pt) can be defined, $$P_t = \left(\frac{\pi G^2 \mu^2}{E\rho} \ddot{t}^2 \times 10^{-5}\right) \times n_f \times 2W$$

where μ is the linear density of the active filament, ρ is the density of NiTi in g/cm$^3$, $\ddot{t}$ is the twist factor, E is the specific tensile modulus in austenite or martensite ($E_a$, $E_m$), G is the specific shear modulus in austenite or martensite ($G_a$, $G_m$), $n_f$, is the number of filament in the yarn bundle, and W is the number of wales that compose the textile.

Each of these elements of the critical tensile force can be further defined. For example, linear density of the active filament can be defined as $$\mu = \pi r^2 \times 10^5 \rho$$

The twist factor ($\ddot{t}$) for each active filament can be determined according to the linear density of the filament (μ) and the twist (t) per centimeter $$\ddot{t} = t\sqrt{\mu}$$

TABLE 1

Parameters for critical buckle calculation. Linear density (μ), martensitic tensile modulus ($E_m$), martensitic shear modulus ($G_m$), austenitic tensile modulus ($E_a$), austenitic shear modulus ($G_a$), twist (t), and twist factor ($\ddot{t}$) for active filaments with 0.00762 cm and 0.0127 cm diameters.

| d [cm] | μ [tex] | $E_m$ [gf/tex] | $G_m$ [gf/tex] | $E_a$ [gf/tex] | $G_a$ [gf/tex] | t [$cm^{-1}$] | $\ddot{t}$ [$tex^{1/2}$ turns/cm] |
|---|---|---|---|---|---|---|---|
| 0.00762 | 29.4 | 3.0 | 1.1 | 6.7 | 2.5 | 1.8 | 9.76 |
| | | | | | | 3.5 | 18.98 |
| | | | | | | 4.7 | 25.49 |
| 0.0127 | 81.7 | 2.5 | 0.9 | 6.3 | 2.4 | 1.8 | 16.27 |
| | | | | | | 3.5 | 31.64 |
| | | | | | | 4.7 | 42.48 |

Figure 19:
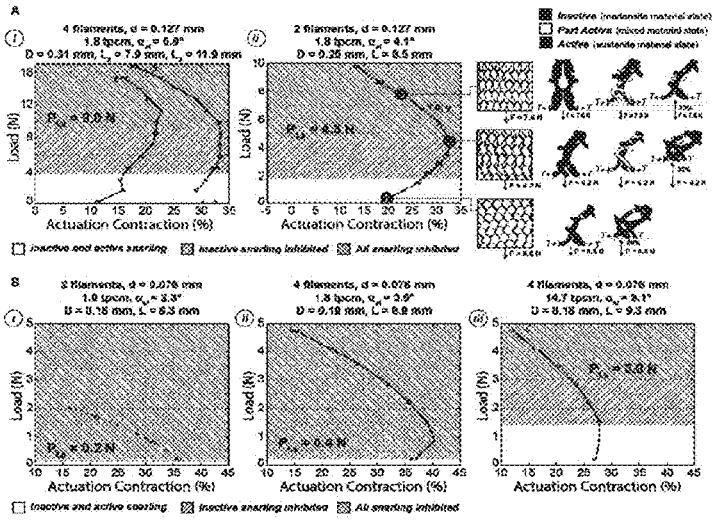
FIG. 19 shows the relationship between applied load and the percentage of actuation contraction that can be achieved.

The critical tension to prevent textile buckling in an austenite or martensite material state ($P_{t,a}$, $P_{t,m}$) can then be determined by scaling the filament buckling value Pf, by the number of filaments ($n_f$) and the number of yarns in parallel in a knit structure, which is twice the number of knitted wales (2W). While the relationship between the yarn diameter (D) and the loop length (L) determines the percentage of actuation contraction that can be achieved, the austenitic critical tension to prevent buckling ($P_{t,a}$) appears to be a very good indicator of the applied load at which maximum actuation occurs, as shown in FIG. 19.

Because the active filaments undergo phase transformation from martensite to austenite, each textile has a critical martensite buckling tension ($P_{t,m}$) and a critical austenite buckling tension ($P_{t,a}$).Maximum actuation performance of a given active textile composed of torque-unbalanced yarns with stresses below the identified critical stress ($\sigma_{eq} \leq \sigma_e$=663 MPa) occurs when an applied load (F) is approximately equal to the austenitic critical buckling force of the textile ($P_{t,a}$), $$P_{t,a} \cong F, \text{ when } \sigma_{eq} \leq \sigma_e \quad (4)$$

where martensitic buckling is eliminated, and austenitic snarl is not yet inhibited. Additionally, we demonstrate that maximum actuation performance shifts to an applied load equal to the martensitic critical buckling force of the textile ($P_{t,m}$) when equivalent material stresses surpass the identified critical stress ($\sigma_{eq} \geq \sigma_e$=663 MPa).

$$P_{t,m} \cong F, \text{ when } \sigma_{eq} \geq \sigma_e \quad (5)$$

Because the active filaments cannot fully accomplish phase transformation (which optimizes austenitic loop buckle), maximum actuation contraction of occurs when the applied load removes pre-actuation martensitic buckling—maximizing the kinematic motion of loop flip. These theoretical points of maximum kinematic rotation are shown to produce amplified actuation properties for any given active textile.

TABLE 2

Tension to prevent buckling in yarns. The critical tension to prevent buckling of a torque-unbalanced yarn differs according to the material state, number of filaments, and twist per unit length.

| | | Martensite | | | Austenite | | |
|---|---|---|---|---|---|---|---|
| | | 2-filament | 3-filament | 4-filament | 2-filament | 3-filament | 4-filament |
| d [cm] | t [$cm^{-1}$] | $P_{m,f2}$ [N] | $P_{m,f3}$ [N] | $P_{m,f4}$ [N] | $P_{a,f2}$ [N] | $P_{a,f3}$ [N] | $P_{a,f3}$ [N] |
| 0.00762 | 1.8 | 0.1 | 0.2 | 0.2 | 0.2 | 0.3 | 0.4 |
| | 3.5 | 0.4 | 0.6 | 0.8 | 0.8 | 1.3 | 1.7 |
| | 4.7 | 0.7 | 1.0 | 1.4 | 1.5 | 2.3 | 3.0 |

TABLE 2-continued

Tension to prevent buckling in yarns. The critical tension to prevent buckling of a torque-unbalanced yarn differs according to the material state, number of filaments, and twist per unit length.

| | | Martensite | | | Austenite | | |
|---|---|---|---|---|---|---|---|
| d [cm] | t [$cm^{-1}$] | 2-filament $P_{m,f2}$ [N] | 3-filament $P_{m,f3}$ [N] | 4-filament $P_{m,f4}$ [N] | 2-filament $P_{a,f2}$ [N] | 3-filament $P_{a,f3}$ [N] | 4-filament $P_{a,f3}$ [N] |
| 0.0127 | 1.8 | 1.8 | 2.7 | 3.6 | 4.5 | 6.8 | 9.0 |
| | 3.5 | 6.8 | 10.1 | 13.5 | 17.0 | 25.6 | 34.1 |
| | 4.7 | 12.2 | 18.3 | 24.4 | 30.7 | 46.1 | 61.5 |

Figure 20A:
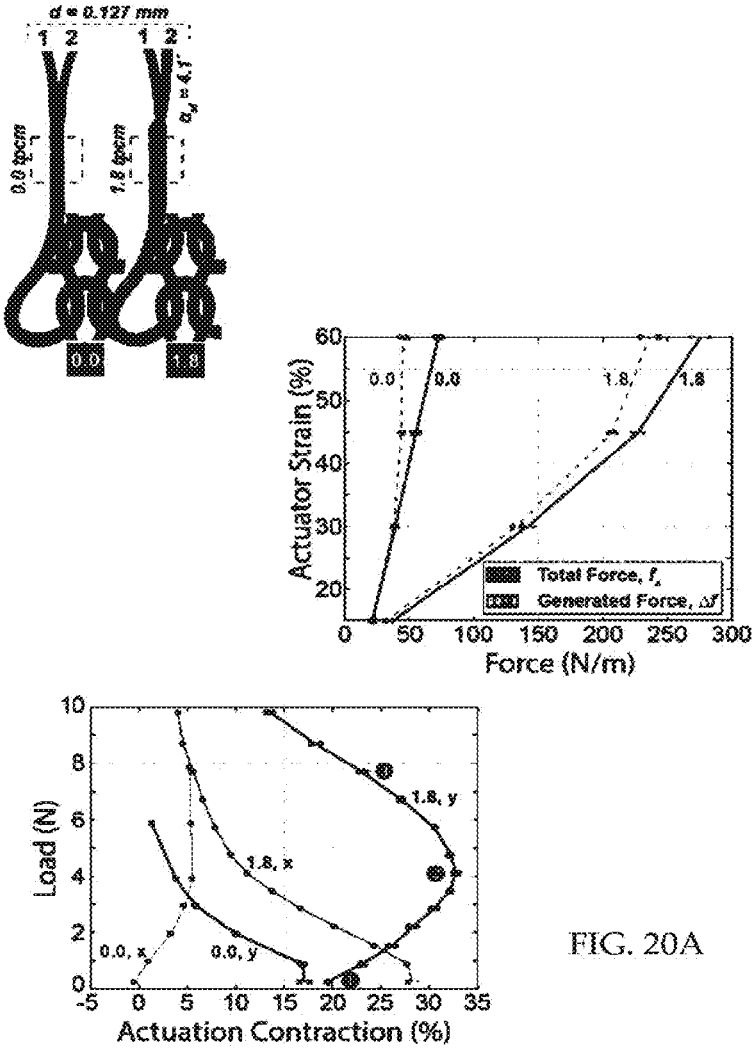
FIGS. 20A and 20B show a comparison of actuation performance of torque-balanced and torque-unbalanced active textiles.
Figure 20B:
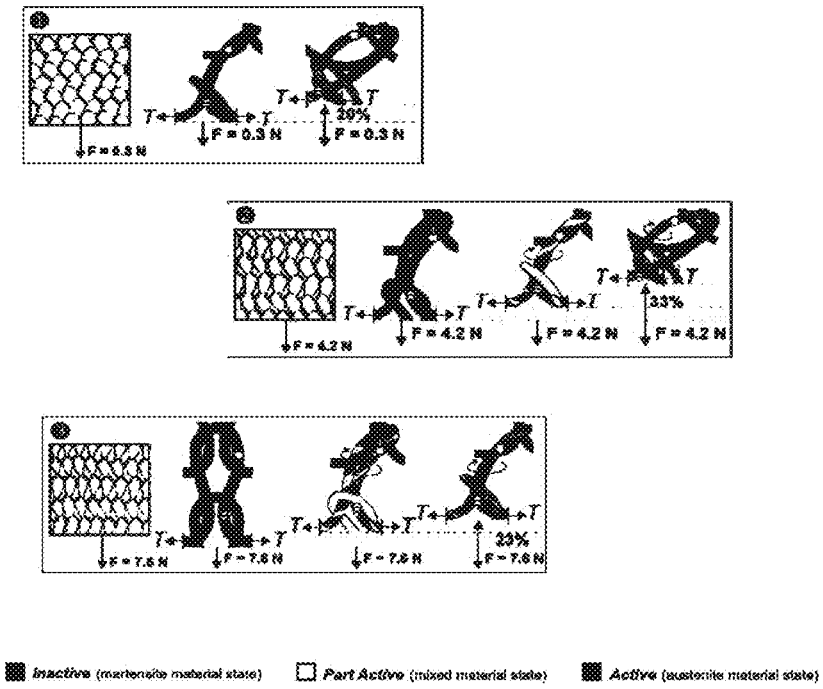

To compare the actuation performance of torque-balanced and torque-unbalanced active textiles, two active textiles were manufactured—one composed of two parallel filaments (d=0.127 mm) reconfigured into a textile geometry (D=0.25 mm, L=9.0 mm) and the other composed of an equivalent textile geometry (D=0.25 mm, L=8.5 mm) made from a torque-unbalanced yarn (two filaments, d=0.127 mm, 1.8 tpcm, $\alpha_{sf}$=4.1°) with stresses below the critical stress ($\sigma_{eq}<\sigma_e$) (FIGS. 20A and 20B). Oriented along the y-axis, which has been the preferential actuation orientation in prior work, total blocked force ($f_a$) increased by 283% and generated force ($\Delta f$) increased by 424% in response to the increased stress state of the material ($f_{a,0.0}$=72 N/m, $f_{a,1.8}$=276 N/m; $\Delta f_{0.0}$=45 N/m, $\Delta f_{1.8}$=236 N/m).

Additionally, maximum actuation contraction nearly doubled in the y-axis between torque-balanced (0.0, y=17.5%) and torque-unbalanced (1.8, y=33%) active textiles. Maximum actuation contraction of the torque-balanced active textile occurred under minimum loading conditions. Conversely, the actuation contraction of the torque-unbalanced textile (t=1.8 tpcm) peaked at about 4.1 N. Under low applied loads (F<1.8 N), maximum actuation contraction for the torque-unbalanced active textile did not occur because the applied loads (F) were not sufficient to overcome either the martensitic or austenitic critical buckling force for the textile ($P_{t,m}$, $P_{t,a}$). Consequently, only partial loop rotation occurred upon actuation. Under large applied loads (F>4.5N), snarl formation (i.e., rotation) in the knitted loop was inhibited because the applied loads (F) were greater than both the austenitic and martensitic critical buckling tensile forces ($P_{t,m}$, $P_{t,a}$). Maximum actuation contraction occurred at an applied load (F) of 4.5 N, which was approximately equivalent to the austenitic critical buckling tensile force. Experimental data demonstrates a comparable alignment between textiles composed of high stress yarns ($\sigma_e<\sigma_{eq}$) and the martensitic critical buckling force ($P_{t,m}$). Because filament twist increases material stresses without increasing material mass, this increase in actuation displacement translated to a large increase in an active textile's specific work.

The geometry of knitted loop buckle and snarl also enhances actuation performance in the x-axis of the torque-unbalanced active textile. The torque-balanced active textile shown in FIG. exhibited slight expansion (rather than contraction) under low load (F=0.25 N) as the knitted loop head apexes stiffened and broadened across a 2D plane, a behavior that is consistent with a positive Poisson's Ratio textile. For a torque-unbalanced active textile (t=1.8 tpcm), actuation contraction in the x-axis was enabled by the introduction of filament torsion, which causes the knitted loop head to reverse about the y-axis and shorten the spacing between loops in the x-axis. As applied loads increased for both textiles, x-axis actuation contraction settled at 5%—the maximum actuation contraction for a SMA yarn. This comparative analysis of torque-balanced and torque-unbalanced active textiles illustrates that both textiles exhibit structurally anisotropic performance—accomplishing different actuation contraction and specific work in perpendicular axes—with instances of identical (overlapping) performance. The analysis also suggests that torque-unbalanced active textiles can accomplish a larger performance range than torque-balanced active textiles, which can be tuned by strategically modifying design variables within the textile hierarchy.

It should be understood that tension and torque can also be applied due to the overall geometry of the garment. For example, a knitted garment in a twisted loop (e.g., a Möbius loop) can maintain a level of tension on the yarns or fibers that make up the garment. More complex garment shapes or arrangements of knit patterns within a larger structure can result in a variety of tensions throughout that structure, which can be selectively arranged to create desired buckling behavior (or lack thereof) as different active materials within the garment are actuated or deactivated.

The actuation properties of active textiles can be further tuned by manipulating yarn construction, which modifies the critical buckling forces of the filament, yarn, and textile ($P_t$) as well as the material stress state. Physics-based relationships for filaments in torsion indicate that increasing the number of active filaments will increase the critical austenitic buckling force in a textile.

Figure 21:
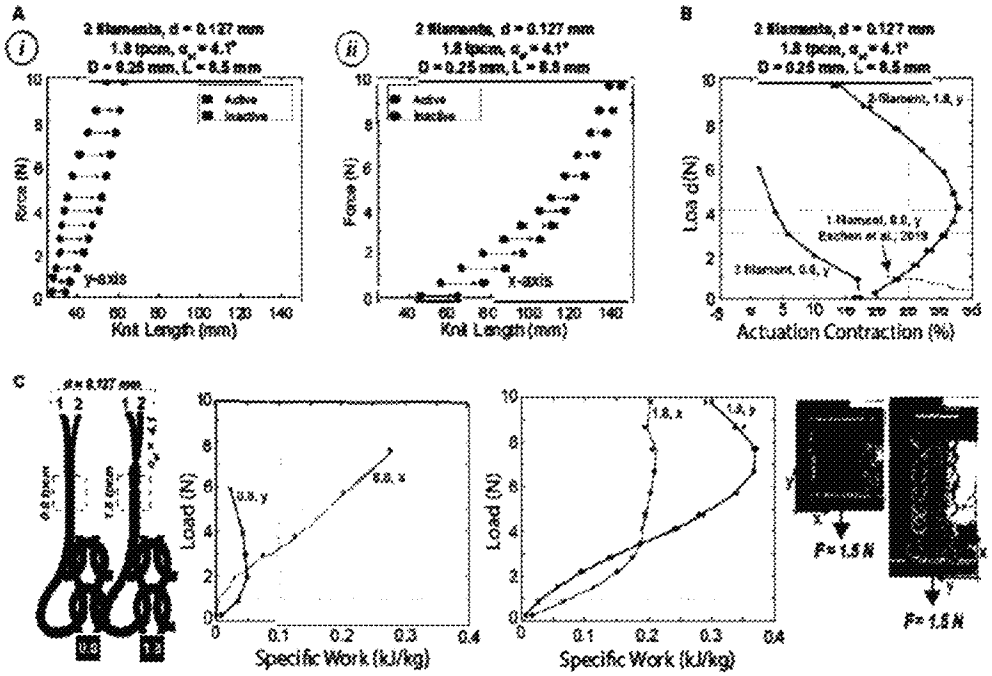
FIG. 21 show the effect of an increasing number of active filaments and twist on the actuation contraction of a textile.

To investigate this relationship, as shown in FIG. 21, two torque-unbalanced active yarns were made with either two or four SMA filaments and otherwise equivalent yarn constructions (i.e., d=0.076 mm, t=1.8 tpcm). Both active yarns 2/1.8 and 4/1.8 had approximately equivalent yarn diameters ($D_{2/1.8}$=0.15 mm; $D_{4/1.8}$=0.18 mm) and were reconfigured into active textiles with approximately equivalent loop lengths ($L_{2/1.8}$=8.3 mm; $L_{4/1.8}$=8.8 mm). Doubling active filaments slightly increased actuation contraction at double the applied load, which corresponded with the increased critical austenitic buckling force ($P_{t,a,2/1.8}$=0.2N; $P_{t,a,2/1.8}$=0.4N). In untwisted constructions, increasing the number of filaments included in a textile decreases actuation contraction by half in response to a reduced ratio of loop enclosed area and active cross-sectional area. In twisted constructions, actuation kinematics are governed by loop buckle and flip (as opposed to bending only), enabling an increase in yarn stiffness without inhibiting actuation motion. This enhanced macroscopic actuation translated to an increase in specific work over 60% (0.16 kJ/kg for two filaments and 0.26 kJ/kg for four filaments, as shown in FIG. 22).

Figure 22:
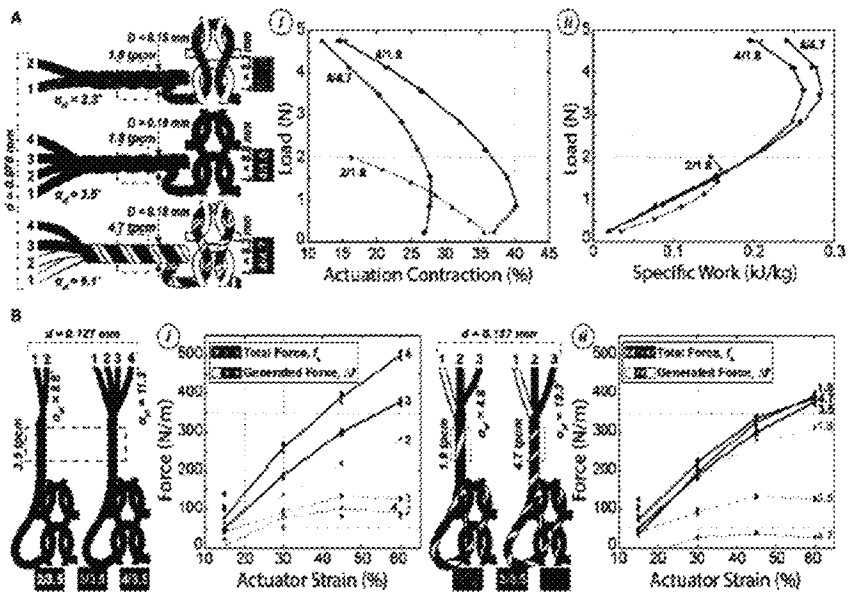
FIG. 22 depicts how kinematic tunability of a textile is enabled by modifications to yarn construction, in embodiments.

As shown in FIG. 22, kinematic tunability is enabled by modifications to yarn construction. Active textiles composed of torque-unbalanced active yarns can be kinematically tuned by modifying the number of filaments included in a yarn bundle and the amount of twist inserted into that yarn bundle. Actuation contraction and maximum specific work is increased by increasing yarn filament count. Above the critical stress state, actuation contraction is reduced by increasing twist per unit length while specific work is unaffected by yarn twist. As shown in pane B, total active force per meter width is approximately doubled by increasing the number of filaments in a yarn bundle while actuation force, or the difference between the active and inactive forces, per meter width is unchanged. Active force per meter width is unaffected by increased twist per unit length; however, above the critical stress state, actuation force per meter width is reduced as twist increases.

Increasing the number of active filaments in a yarn bundle can also increase the total active force ($f_a$) (here, equivalent to an austenite material state force) of an active textile in a structural strain controlled configuration; however, increasing filaments does not affect the active textile's generated force ($\Delta f$). Three active yarns (FIG. 3B, 2/3.5, 3/3.5, and 4/3.5) were made with either two, three, or four SMA filaments and otherwise equivalent yarn constructions (i.e., d=0.127 mm, t=3.5 tpcm). Yarns 2/3.5, 3/3.5, and 4/3.5 were reconfigured into active textiles with similar average loop lengths of 8.4 mm, 8.3 mm, and 8.2 mm, respectively. Increasing filaments from two to three produced a 40% increase in total active force per meter width ($\varepsilon$=60%; $f_{a,2/3.5}$=278 N/m, $f_{a,3/3.5}$=378 N/m, as shown in FIG. 22). Increasing further from two to four filaments produced an over 80% increase in active force per meter width ($\varepsilon$=60%; $f_{a,2/3.5}$=278 N/m, $f_{a,4/3.5}$=500 N/m). The generated force ($\Delta f$), however, was approximately equivalent for all three textiles. This stabilization of generated force occurred because active force ($f_a$) and inactive force ($f_i$) increase linearly with added active material, eliminating gains in generated force ($\Delta f = f_a - f_i$ as described above).

While the addition of filament torsion has been shown to enhance actuation properties in an active textile, the behavior of active filaments and yarns in torsion suggests that actuation performance in a textile should decrease when filaments are stressed beyond a critical stress state. To investigate this relationship in a textile, two active yarns shown in FIG. 22 were made with either 1.8 or 4.7 tpcm to produce different stress states ($\sigma_{eq,4/1.8}$=658 MPa; $\sigma_{eq,4/4.7}$=680 MPa, Table S5). Otherwise, both yarns 4/1.8 and 4/4.7 had equivalent yarn constructions (i.e., d=0.076 mm, four filaments) and textile geometries ($L_{4/1.8}$=8.8 mm; $L_{4/4.7}$=9.3 mm). Increasing yarn twist from 1.8 tpcm to 4.7 tpcm decreased maximum actuation contraction from 40% (4/1.8) to 28% (4/4.7), indicating reduced phase transformation at the outer filament radius. The increase in twist had little effect on specific work, which was approximately equivalent for active textiles 4/1.8 and 4/4.7 (FIG. 3A, ii). Here, equivalent specific work can be attributed to a decrease in sample mass (m) between samples 4/1.8 and 4/4.7 ($m_{4/1.8}$=264 mg, $m_{4/4.7}$=170 mg), which occurred in response to filament packing and elongation produced during high-twist yarn spinning.

Still referring to FIG. 22, surpassing the critical stress state of active yarns also produces textiles that exhibit reduced blocked force in structural strain-controlled conditions. To demonstrate, three active yarns (i.e., d=0.127 mm, three filaments) were constructed with 1.8 tpcm, 3.5 tpcm, and 4.7 tpcm and equivalent textile geometries. Increasing twist from 1.8 to 3.5 to 4.7 did not affect total active force ($\varepsilon$=60%; $f_{a,3/1.8}$=395 N/m, $f_{a,3/3.5}$=379 N/m, $f_{a,3/4.7}$=388 N/m). Generated force ($\Delta f$), however, declined with increased yarn twist. Increasing twist from 1.8 tpcm to 3.5 tpcm produced a 60% drop in generated force ($\varepsilon$=60%; $\Delta f_{3/1.8}$=308 N/m, $\Delta_{f3/3.5}$=126 N/m). Further increasing twist to 4.7 tpcm produced a 90% drop in generated force ($\varepsilon$=60%; $\Delta f_{3/1.8}$=308 N/m, $\Delta f_{3/4.7}$=29 N/m). This decrease in generated force can be directly attributed to increased manufacturing stresses ($\sigma_{eq,3/1.8}$=620 MPa; $\sigma_{eq,3/3.5}$=820 MPa $\sigma_{eq,3/4.7}$=1180 MPa; Table S5) that reduce material phase change potential at the outer filament radius when above 663 MPa. The total active force did not decrease because the structures were dominated by a stiff, detwinned martensite material state. These results demonstrate that manipulating filament stresses through yarn spinning and modifying yarn-level geometric design parameters to manipulate the critical buckling forces are effective design tools to tune the mechanical performance of active textiles for applications with specific actuation contraction, work, or generated force requirements.

Multifunctional Applications

As described above, materials can be used to form compression garments that begin looser (inactive) and become tighter upon actuation. Haptic feedback garments can be created using these materials that have larger range of shape change potential. On-body compression garments can be generated that start out with low, inactive forces, and reach higher force applied compared to monofilaments of the same SMA materials. Other applications can include suturing or fabric-like systems, which are analogous to shape-change fabrics but can be deployed within the body. Energy absorption is also contemplated, as described above, such as fabrics or pads that are arranged in a shoe for force absorption, or in a vest or sporting apparel like a football helmet or ski suit to prevent injury from impacts.

Figure 23:
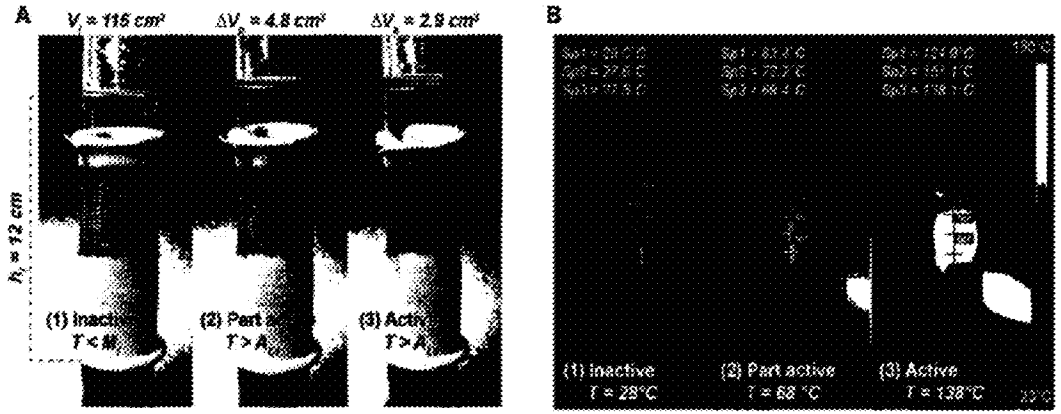
FIG. 23 shows transition from inactive to partially active to fully active compression for a variable recruitment active textile sleeve.

By scaling the dimensions of a 2D active textile sample, the multifunctional properties of a textile sample can be translated to a 3D system architecture. When composed of variable recruitment 1D active yarns, 2D active textiles and 3D system architectures exhibit sequential, temperature-dependent actuation. For example, as shown in FIG. 23, a variable recruitment active textile sleeve can be wrapped around a fluid-filled silicone cylinder (V=115 $cm^3$) to demonstrate variable constriction capabilities. In a fully inactive material state ($T<M_f$), the circumferential force produced by the sleeve did not affect the initial fluid height, which was 12 cm. Upon increasing the thermal load above the active temperature for one active material element (e.g., T=68° C.), the active textile sleeve contracted, producing a force greater than the critical buckling force of the elastic tube. Tube buckling was accompanied by a reduction in cross-sectional area, which produced a 5 mm increase in water height and a corresponding 4.8 $cm^3$ fluid volume displacement (FIG. 5A). Further increase in temperature (T=138° C.) recruited the second active filament, which increased the water height an additional 3 mm and displaced an additional fluid volume of 2.9 $cm^3$. Characterization was conducted with an infrared camera to correlate applied temperature to changing fluid column height. The variable constriction pump is an example of one of many applications that benefits from variable recruitment actuation behavior embedded within distributed and scalable active textiles. Aggregating multiple variable constriction pump units would enable peristaltic motions and/or localized flow control.

Novel modes of textile-based actuation are demonstrated here through three prototypes, including (a) a variable constriction pump that utilizes variable recruitment yarn compositions to perform sequential actuation, (b) an active auxetic shoe that conforms multi-axially around the complex contours of the foot, and (c) an assistive wrist sleeve that simultaneously anchors itself around the wrist and provides motion assistance, leveraging the actuation contraction and work capabilities of active textiles across multiple axes. These advances in active textiles, enabled by exploiting the structural elastic instability of torque-unbalanced active filaments and yarns within traditional textile geometries, demonstrate new modes of actuation, scaled across 1D, 2D, and 3D spheres, that diversify the types of approaches available for a wide range of multifunctional applications. Advances in 2D programmable surfaces can be implemented in multifunctional 3D applications, such as a variable constriction pump that exhibits sequential actuation, a wearable that conforms multi-axially around the body, or a soft exoskeleton that performs assistive motions and on-body anchoring simultaneously. By harnessing the capabilities of active materials within a textile hierarchy, the potentiality of functional textiles in enhanced.

Figure 24A:
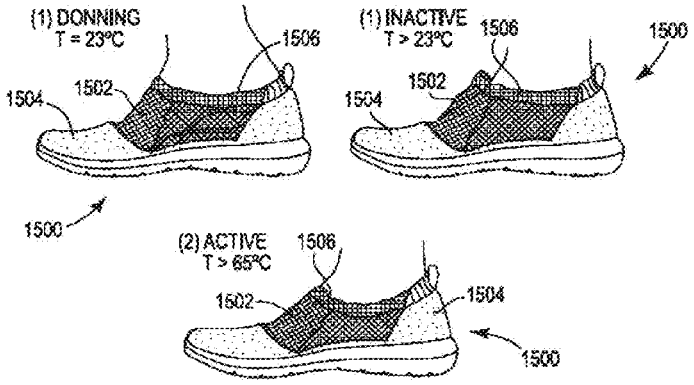
FIGS. 24A and 24B show an active fabric shoe, according to an embodiment.
Figure 24B:
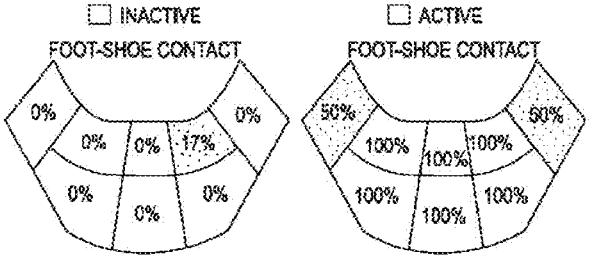

Active textiles can contract in multiple orientations, enabling a 3D system architecture to accomplish active auxetic behaviors and conform around complex 3D volumes. FIGS. 24A and 24B depict a shoe according an embodiment, similar to the one described in copending application PCT/US2020/050495 and commonly assigned to the instant application, the contents of which are incorporated by reference in their entirety.

Auxetic behavior can be leveraged in applications such as contractile wearables that provide dynamic fit adjustments in product lengths and widths, as shown in FIGS. 24A and 24B. Here, auxetic capabilities provide enhanced shoe fit accuracy and stiffness, features desirable in footwear and many wearable robotic applications. In an inactive material state (T<Mf), a multi-axially conforming shoe has a compliant and oversized knitted upper composed of active textiles and can be pulled easily over the foot. Upon thermal stimulation (T>Δf), the shoe upper contracts and stiffens in length and width to provide a supportive and contoured hold around the foot. While the auxetic system architecture is demonstrated with a common, high-temperature SMA material (i.e., 90° C. FLEXINOL®), the design methods can be replicated using alternative SMA composition, such as low-temperature, nickel-rich SMA, or an alternative active material, such as a shape memory polymer, to enable self-fitting with body heat or active fitting with low applied heat. For dynamically conforming wearables that do not apply significant compression force to the body, system patterns, which are composed of 2D active textiles and wrapped around a volume to form a 3D system architecture, were designed to match the body dimensions in an active material state. Inactive system dimensions were consequently larger than the body dimensions.

Evaluation of the system body interface through a contact measurement method demonstrates little contact between the active textile upper and the foot before actuation and nearly 100% contact upon actuation. The slight contact measurement in an inactive material state (17%) in the upper right portion of the shoe upper occurred from the active textile falling under its own weight and resting on the foot during some test trials. While good contact (100%) was achieved throughout the center part of the active textile upper upon actuation, the sides of the upper accomplished unstable contact (50%). These side regions, which interface with the foot arch, could accomplish improved contact by changing the shape of the rubber shoe sole, which was wide for the foot cast. The results demonstrate that active textiles that exhibit active auxetic effects can enable multi-directional contraction and stiffening around complex volumes, capabilities that could improve the system-body interface of wearable robotics, wearable haptic systems, and a vast number of consumer products.

According to another embodiment and as shown in FIG. 25, multifunctional system architectures are demonstrated in an assistive wrist sleeve. As shown in panel (A), the assistive wrist sleeve design with anatomical and dynamic anchors. As shown in panel (B), the inactive assistive wrist sleeve allows the wrist to assume a natural flexion, with angle, αi. Upon thermal loading, the sleeve contracts to lift the hand and simultaneously anchor around the wrist to produce an extended position, represented by a reduced angle, aa. As shown in panel (C), actuation was observed with an infrared camera. As shown in panel (D), image tracking was conducted to track hand motion and characterize wrist angle change upon actuation.

Active textiles can perform structurally anisotropic actuation contraction in two different orientations, enabling 3D systems to accomplish discrete tasks in perpendicular axes. Here, an assistive wrist sleeve is designed to provide motion assistance to the wrist joint by lifting the hand from a natural, flexed position to a neutral position upon actuation. Extension of the wrist is primarily driven by actuation contraction along the dorsal length of the hand and wrist, which lifts the hand from a flexed position (associated with a longer dorsal length) to a neutral position (associated with a shortened dorsal length). To translate dorsal length actuation contraction of the active textile glove to a change in wrist angle, the glove must be anchored, proximally and distally, to the body. In prior wearable robotic demonstrations, anchoring around the body has been accomplished with passive, adjustable straps and braces that increase device complexity and discomfort. Dynamic anchoring around the body with a multifunctional and structurally anisotropic active textile that can contract circumferentially around the conical volume of the low wrist and, at the same time, lift the weight of the hand. While the finger gussets of a glove provide simple mechanical anchoring distally, shifting proximal anchoring to a dynamic and impermanent mechanism improves device wear comfort and usability. For contractile systems that generate forces around the body and/or lift loads (e.g., the hand), system patterns are developed around active textile dimensions under a fixed actuator strain and/or an applied load. Active material state system dimensions are consequently smaller than the body dimensions.

As shown in FIG. 25B, panel (A), active textile dimensions are arranged in an inactive and active material state. As shown in panel (B) (1), a drape pattern making method was used to develop the initial 2D pattern shape, while in panel (B)(2) the 2D fabric was removed from the 3D shape and laid flat to reveal the flat pattern. As shown in panel (C), the fabric pattern was traced and subdivided into pattern segments corresponding to the function of the wrist sleeve. Finally, as shown in panel (D), dimensional specifications for the active textile assistive wrist sleeve in inactive and active material states.

Figure 25A:
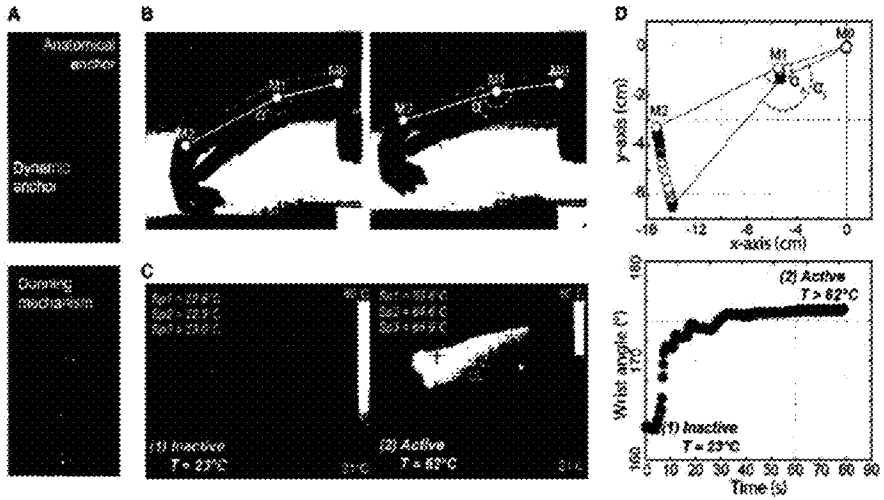

The assistive wrist sleeve was characterized through a standard motion tracking analysis. In an inactive material state (T<Mf), the wrist fell under the weight of the hand, producing an inactive angle, $\alpha_i$, between marker points M0, M1, and M2. Upon actuation of the topmost region of the wrist sleeve (T>Af), the sleeve contracted to anchor around the wrist and simultaneously lifted the hand, producing an active angle, αa. FIG. 25A depicts the results of infrared imaging analysis used to characterize thermal loading, which was accomplished with a standard heat gun. The assistive wrist sleeve was found to produce a wrist angle change of 12. The flexed angle of the wrist while the device was in an inactive material state (αi) was 163°. Device actuation produced a maximum angle extension (αa) of 175°. The results demonstrate successful use of structurally anisotropic actuation within a system, as the change in wrist angle could only be accomplished with both longitudinal contraction and distal dynamic anchoring to translate contraction to hand lift. Future work will investigate the design of wearable devices using alternative active material compositions, such as SMA materials that can be actuated at lower temperatures, and heating and cooling regimes designed to improve thermal comfort.

According to one embodiment, consumer shapewear begins in a looser (inactive) state and becomes tight upon actuation. In another embodiment, a dynamic wearable bracing (e.g. ankle brace, knee brace) is contemplated that can be turned on or off or tuned in stiffness. Self-fitting garments can be designed using the tunable variables described above such that the garments are pulled towards the body with a superelastic or SMA element in a yarn bundle, which is actuated with body heat to self-fit once the fabric is in contact with the body.

Self-fitting shoe uppers and clothing with auxetic capabilities are contemplated that enable the shoe upper or garment to expand and contract bi-directionally in response to changing foot/body volume between users. Robotic garments with actuator fabrics integrated in locations can be designed that facilitate movement (e.g., plantar flexion, elbow abduction) or assist lifting external loads (e.g., assembly line worker exoskeletons). Wearable mechanical damping fabrics can be designed for any other purpose that impacts the body, like backpack straps, hardhats or helmets, shin guards and elbow pads, shoe soles, or body armor, for example.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A yarn comprising:

a plurality of fibers arranged in the yarn, wherein:

at least one fiber of the plurality of fibers is made up of an active material having a corresponding transformation stimulus, the at least one fiber has a twist angle, a filament helical bias angle, a diameter, and an applied torsion configured to generate an output capacity that exceeds the output capacity corresponding to the at least one fiber in an untwisted state, and wherein the yarn is arranged in a knit pattern that corresponds to a fabric that exhibits variable recruitment wherein a subset of the plurality of fibers comprising the at least one fiber has different characteristics than a second subset of the plurality of active fibers;

wherein the first subset of the plurality of fibers differs from the second subset of the plurality of fibers in at least one of fiber diameter, material composition, filament helical bias angle, or knit pattern; and wherein the fabric is pre-tensioned with a critical tensile force required to prevent yarn snarl formation according to the equation:

$$P_t = \left(\frac{\pi G^2 \mu^2}{E\rho} \ddot{t}^2 \times 10^{-5}\right) \times n_f \times 2W$$

where μ is the linear density of the at least one fiber, ρ is the density of the at least one fiber, $\ddot{t}$ is the twist factor of a yarn corresponding to the first fiber, E is the specific tensile modulus of the first fiber in either martensite or austenite state, G is the specific shear modulus of the first fiber in either austenite or martensite state, $n_f$ is the number of filament in the first yarn, and W is the number of wales that compose a fabric.

2. A fabric comprising:

a plurality of fibers, wherein at least one fiber of the plurality of fibers is made up of an active material having a transformation stimulus, wherein the plurality of fibers are divided into subsets, each subset corresponding to one of a plurality of yarns, such that the filaments within each yarn of the plurality of yarns are intertwined at a filament helical bias angle, and wherein a blocked force is applied to a first yarn that includes the at least one fiber wherein the blocking force is equal to an inactive buckling tension of the first yarn, wherein the plurality of fibers comprises a plurality of active fibers, and wherein a first subset of the plurality of active fibers has different characteristics than a second subset of the plurality of active fibers;

wherein the first subset of the plurality of active fibers differs from the second subset of the plurality of active fibers in at least one of fiber diameter, material composition, filament helical bias angle, or knit pattern; and wherein the fabric is pre-tensioned with a critical tensile force required to prevent yarn snarl formation according to the equation:

$$P_t = \left(\frac{\pi G^2 \mu^2}{E\rho} \ddot{t}^2 \times 10^{-5}\right) \times n_f \times 2W$$

where μ is the linear density of the at least one fiber, ρ is the density of the at least one fiber, $\ddot{t}$ is the twist factor of a yarn corresponding to the first fiber, E is the specific tensile modulus of the first fiber in either martensite or austenite state, G is the specific shear modulus of the first fiber in either austenite or martensite state, $n_f$ is the number of filament in the first yarn, and W is the number of wales that compose the fabric.

3. The fabric of claim 2, wherein the critical inactive buckling tension is a critical martensite buckling tension of the first yarn.

4. The fabric of claim 2, wherein the blocked force on the first yarn is sufficient to inhibit a buckling rotation when at least one fiber is in an inactive state but not at a temperature at which the at least one fiber is in an active state.

* * * * *